US009848683B2

(12) United States Patent
Sayers et al.

(10) Patent No.: US 9,848,683 B2
(45) Date of Patent: Dec. 26, 2017

(54) HAIR STYLING DEVICE

(71) Applicant: JEMELLA LIMITED, Leeds (GB)

(72) Inventors: Stephen Anthony Sayers, Buckinghamshire (GB); Daniel Brady, Berkshire (GB); Jason Palmer, Cambridgeshire (GB)

(73) Assignee: JEMELLA LIMITED, Leeds (GB)

( * ) Notice: Subject to any disclaimer, the term of this patent is extended or adjusted under 35 U.S.C. 154(b) by 0 days.

(21) Appl. No.: 14/422,542

(22) PCT Filed: Aug. 19, 2013

(86) PCT No.: PCT/GB2013/052188
§ 371 (c)(1),
(2) Date: Feb. 19, 2015

(87) PCT Pub. No.: WO2014/029980
PCT Pub. Date: Feb. 27, 2014

(65) Prior Publication Data

US 2015/0216280 A1 Aug. 6, 2015

(30) Foreign Application Priority Data

| | | |
|---|---|---|
| Aug. 20, 2012 | (GB) | 1214777.3 |
| Dec. 3, 2012 | (GB) | 1221671.9 |
| Apr. 12, 2013 | (GB) | 1306648.5 |

(51) Int. Cl.
*A45D 2/00* (2006.01)
*A45D 1/04* (2006.01)
(Continued)

(52) U.S. Cl.
CPC ..... *A45D 2/001* (2013.01); *A45D 1/04* (2013.01); *A45D 1/06* (2013.01); *A45D 2/40* (2013.01);
(Continued)

(58) Field of Classification Search
CPC . A45D 1/04; A45D 1/06; A45D 2/001; A45D 2/40; A45D 2001/045; D06F 45/02;
(Continued)

(56) References Cited

U.S. PATENT DOCUMENTS 527,176 A * 10/1894 Johnson ..... A45D 1/06 132/263
824,742 A * 7/1906 Richardson ..... D06F 75/30 38/101
(Continued)

FOREIGN PATENT DOCUMENTS

CN 2503759 Y 8/2002
CN 100858147 B1 9/2008
(Continued)

OTHER PUBLICATIONS

British Search Report for corresponding application GB1221674.3; dated Mar. 19, 2013.
(Continued)

*Primary Examiner* — Todd E Manahan
*Assistant Examiner* — Jennifer Gill
(74) *Attorney, Agent, or Firm* — Cantor Colburn LLP

(57) ABSTRACT

A shoulder assembly for connecting two arms of a hair styling apparatus, the shoulder assembly comprising: a housing; a first coupling member which is attached to the housing and which projects from the housing to couple the housing to a first arm; a second coupling member which is attached to the housing and which projects from the housing to couple the housing to a second arm; wherein both the first and second coupling members are flexible so that the first arm is movable relative to the second arm when the shoulder assembly is connected to the first and second arms.

17 Claims, 20 Drawing Sheets

(51) Int. Cl.
*A45D 1/06* (2006.01)
*A45D 2/40* (2006.01)

(52) U.S. Cl.
CPC . *A45D 2001/045* (2013.01); *Y10T 403/32606* (2015.01)

(58) Field of Classification Search
CPC ..... D06F 71/023; D06F 75/00; D06F 75/34; Y10T 16/525; Y10T 403/32606
USPC ..... D28/35; 294/99.2
See application file for complete search history.

(56) References Cited

U.S. PATENT DOCUMENTS

| | | | | | |
|---|---|---|---|---|---|
| 866,778 | A * | 9/1907 | Eldridge | A45D 1/06 | 132/263 |
| 996,821 | A * | 7/1911 | Wulff | A45D 1/06 | 132/263 |
| 3,182,667 | A * | 5/1965 | Den Beste | A45D 1/06 | 132/232 |
| 4,196,343 | A | 4/1980 | Han | | |
| 4,267,430 | A | 5/1981 | Downey | | |
| 4,424,437 | A | 1/1984 | Walter | | |
| 4,553,343 | A * | 11/1985 | Primati | D06F 71/046 | 38/33 |
| 4,917,078 | A | 4/1990 | Zaborowski | | |
| 4,953,266 | A | 9/1990 | Trinkaus | | |
| 5,243,683 | A | 9/1993 | Yang | | |
| 5,865,188 | A * | 2/1999 | Marquez | A45D 2/001 | 132/132 |
| 5,952,812 | A | 9/1999 | Maeda | | |
| 6,199,295 | B1 | 3/2001 | Smal | | |
| 6,393,718 | B1 | 5/2002 | Woodard | | |
| 6,457,953 | B1 | 10/2002 | Bradbury | | |
| 6,494,216 | B1 | 12/2002 | Hirata | | |
| 6,627,852 | B1 | 9/2003 | Savone | | |
| 7,458,622 | B2 * | 12/2008 | Tardif | A47J 43/283 | 294/16 |
| 7,748,391 | B2 * | 7/2010 | Vance | A45D 24/04 | 132/126 |
| 8,544,476 | B1 * | 10/2013 | Marquardt | A45D 1/00 | 132/224 |
| D719,296 | S * | 12/2014 | Brady | D28/35 | |
| 9,698,767 | B2 | 7/2017 | Tuttle | | |
| 2001/0014373 | A1 | 8/2001 | Lin | | |
| 2002/0189128 | A1 | 12/2002 | Nakagawa | | |
| 2003/0007872 | A1 | 1/2003 | Bradbury | | |
| 2003/0089700 | A1 | 5/2003 | Chang | | |
| 2004/0003824 | A1 | 1/2004 | Habibi | | |
| 2004/0041684 | A1 | 3/2004 | Mandell | | |
| 2006/0157996 | A1 * | 7/2006 | McRorie, III | A47G 21/10 | 294/16 |
| 2007/0220773 | A1 | 9/2007 | Evanyk | | |
| 2007/0283529 | A1 * | 12/2007 | Hashizume | E05D 1/02 | 16/225 |
| 2008/0173322 | A1 * | 7/2008 | Leung | A45D 1/04 | 132/232 |
| 2008/0216860 | A1 | 9/2008 | Legrain | | |
| 2008/0236609 | A1 | 10/2008 | Wong | | |
| 2008/0240690 | A1 | 10/2008 | Ono | | |
| 2008/0283080 | A1 | 11/2008 | Habibi | | |
| 2009/0284031 | A1 * | 11/2009 | Pavicsits | A47J 43/283 | 294/16 |
| 2009/0293300 | A1 | 12/2009 | Merritt | | |
| 2010/0083978 | A1 | 4/2010 | Hottenrott | | |
| 2011/0079237 | A1 * | 4/2011 | Price | A45D 1/06 | 132/224 |
| 2013/0239427 | A1 | 9/2013 | Quessard | | |
| 2014/0130365 | A1 * | 5/2014 | Dineen | A45D 20/12 | 34/60 |

FOREIGN PATENT DOCUMENTS

| | | | |
|---|---|---|---|
| DE | 102010002795 | A1 | 9/2011 |
| EP | 2077343 | A1 | 8/2009 |
| EP | 2255692 | A1 | 1/2010 |
| EP | 2377419 | A1 | 10/2011 |
| GB | 235937 | | 6/1925 |
| GB | 573009 | | 11/1945 |
| GB | 1519930 | | 8/1978 |
| GB | 2067097 | A | 7/1981 |
| GB | 2142817 | A | 1/1985 |
| GB | 2167946 | A | 6/1986 |
| GB | 2477834 | A | 8/2011 |
| JP | H08256818 | A | 10/1996 |
| JP | 2008104499 | A | 5/2008 |
| JP | 2010274050 | A | 12/2010 |
| KR | 20070083323 | A | 8/2007 |
| KR | 1020090005460 | A | 1/2009 |
| KR | 20090119155 | A | 11/2009 |
| KR | 20100041337 | A | 4/2010 |
| KR | 1020110106051 | A | 9/2011 |
| SU | 1567169 | A1 | 5/1990 |
| WO | 8000783 | A1 | 5/1980 |
| WO | 9603013 | A | 2/1996 |
| WO | 9610349 | A1 | 4/1996 |
| WO | 0111924 | A1 | 2/2001 |
| WO | 0221967 | A1 | 3/2002 |
| WO | 2004006712 | A1 | 1/2004 |
| WO | 2007043732 | A1 | 4/2007 |
| WO | 2007078048 | A1 | 7/2007 |
| WO | 2008064075 | A2 | 5/2008 |
| WO | 2009136739 | A2 | 11/2009 |
| WO | 2012028862 | A1 | 3/2012 |
| WO | 2012076885 | A2 | 6/2012 |

OTHER PUBLICATIONS

International Search Report for corresponding application PCT/GB2013/053057 filed Nov. 20, 2013; dated Mar. 18, 2014.
Written Opinion for corresponding application PCT/GB2013/053057 filed Nov. 20, 2013; dated Mar. 18, 2014.
British Search Report for corresponding application GB1211231.4; dated Oct. 19, 2012.
British Search Report for corresponding application GB1212933.4 dated Feb. 21, 2013.
British Search Report for corresponding application GB1212933.4 dated Oct. 16, 2012.
British Search Report for corresponding application GB1214775.7; dated Apr. 18, 2013.
British Search Report for corresponding application GB1214775.7; dated Nov. 9, 2012.
British Search Report for corresponding application GB1214777.3 dated Nov. 13, 2012.
British Search Report for corresponding application GB1221671.9 dated Mar. 26, 2013.
British Search Report for corresponding application GB1306648.5 dated Sep. 19, 2013.
International Search Report for corresponding application PCT/GB2013/051636 filed Jun. 21, 2013; dated Nov. 7, 2013.
International Search Report for corresponding application PCT/GB2013/051648 filed Jun. 24, 2013; dated Jan. 17, 2014.
International Search Report for corresponding application PCT/GB2013/052188 filed Aug. 19, 2013; dated Dec. 18, 2013.
J.A. Curran, "Thermo-physical properties of plasma electrolytic oxide coatings on aluminium", Surface & Coatings Technology 199 (2005) 168-176.
Written Opinion for corresponding application PCT/GB2013/051636 filed Jun. 21, 2013; dated Nov. 7, 2013.
Written Opinion for corresponding application PCT/GB2013/051648 filed Jun. 24, 2013; dated Jan. 17, 2014.
Written Opinion for corresponding application PCT/GB2013/052188 filed Aug. 19, 2013; dated Dec. 18, 2013.

(56) References Cited

OTHER PUBLICATIONS

European Office Action for corresponding European Application 13 796 133.0 citing WO 02/21967A1; dated Aug. 18, 2016.

* cited by examiner

HAIR STYLING DEVICE

FIELD OF THE INVENTION

The invention relates to hair styling apparatus, particular those for straightening and curling hair.

BACKGROUND TO THE INVENTION

There are a variety of apparatus available for styling hair. One form of apparatus is known as a straightener which employs plates that are heatable. To style, hair is clamped between the plates and heated above a transition temperature where it becomes mouldable. Depending on the type, thickness, condition and quantity of hair, the transition temperature may be in the range of 160-200° C.

A hair styling apparatus can be employed to straighten, curl and/or crimp hair.

A hair styling apparatus for straightening hair is commonly referred to as a "straightening iron" or "hair straightener". FIG. 1*a* depicts an example of a typical hair straightener 1. The hair straightener 1 includes first and second arms 4*a*, 4*b* each comprising a heatable plate 6*a*, 6*b* coupled to heaters (not shown) in thermal contact with the heatable plates. The heatable plates are substantially flat and are arranged on the inside surfaces of the arms in an opposing formation. During the straightening process, a squeezing force is applied to the arms so that they rotate about pivot 2 to clamp hair between the hot heatable plates. The hair is then pulled under tension through the plates so as to mould it into a straightened form. The hair straightener may also be used to curl hair by rotating the hair straightener 180° towards the head prior to pulling the hair through the hot heatable plates.

A hair styling apparatus for crimping hair is commonly referred to as a "crimping iron". FIG. 1*b* depicts an example of a typical crimping iron 10. The crimping iron includes first and second arms 14*a*, 14*b* coupled about hinge 12 to allow the arms to open and close. Each arm comprises a heatable plate 16*a*, 16*b* coupled to heaters (not shown) in thermal contact with the heatable plates. The heating plates have a saw tooth (corrugated, ribbed) surface and are arranged on the inside surfaces of the arms in an opposing formation. During the crimping process, the hair is clamped between the hot heatable plates until it is moulded into a crimped shape.

More effective heating, and consequently styling, can be achieved by applying heat to both sides of a quantity of hair. This is why many styling apparatus provide heatable plates on both arms.

One downside of this opposing arm arrangement is that squeezing pressure exerted on the arms can lead to undesired play in movement of the arms, including unintended sideways movement of the arms, known as yaw, and also roll of the arms. An example of the yaw problem is shown in FIGS. 2*a* and 2*b*. In FIG. 2*a*, it can be seen on hair styling apparatus 3 that arm 7, which rotates about pivot 5 relative to arm 9 has become offset as a result of an applied pressure by the user. (It will be appreciated that the offset/yaw has been overemphasised in FIG. 2*a* for illustrative purposes.) FIG. 2*b* is a schematic illustration of the apparatus of FIG. 2*a* showing the bending axes. The correct bending axis b is the dotted line passing along the central short axis of the apparatus. When there is yaw, the bending axis is rotated about an angle $\phi$ to become axis b'.

In the process of clamping hair between the plates, hair may be pushed off the end of the heating plates as the arms are clamped over the hair, meaning the arms need to be released and the quantity of hair reclamped. Another disadvantage of yaw is that it may reduce the surface area in contact with the hair and hence the effectiveness of the styler. Any undesired play in the arm-pivot coupling can be further exaggerated if a user squeezes especially hard to prevent hair escaping. Yaw is particularly problematic when using a hair straightener to create curls by wrapping the hair at least partially around the styler.

The applicant has therefore recognised that radically different approaches are needed to overcome these problems.

SUMMARY OF THE INVENTION

According to one aspect of the invention there is provided a hair styling apparatus comprising a first arm and a second arm joined at one end by a shoulder, wherein the first and second arms are movable between an open position in which the opposed ends of the arms to the shoulder are spaced apart and a closed position in which the opposed ends of the arms are brought together; and a heating zone supported by one of the arms for heating hair between arms, wherein at least one of the arms or the shoulder are resiliently flexible to allow the arms to move between the open and closed position. The arms and shoulder may be formed as a continuous strip with the shoulder curving to form the two arms opposed such the arms oppose one another.

At least one of the resiliently flexible arms or shoulder may be arranged such that first and second arms are biased apart in the open position. The first and second arms may then be urged to the closed position by squeezing the first and second arms together. When released, the fact that at least a portion of one arm is resiliently flexible means that the styling apparatus is able to spring/flex back to its original open position. This obviates the need for a separate pivoting mechanism to couple the two arms together meaning that component count is reduced—for example no spring mechanism to bias the arms apart is required. Furthermore, any play in such a pivot coupling is removed. In this way, yaw and roll of the arms relative to one another is reduced increasing usability, effectiveness and the longevity of the hair styling apparatus.

A portion of one arm or the shoulder may provide this resilient flexibility; or a portion of both arms and the shoulder may be flexible; or the arms and shoulder may flexible along their entire length. In embodiments for example the shoulder region which joins the arms may be resiliently flexible and the arms may have minimal or no flex, in other embodiments the shoulder region may have limited flex and further flexing may be provided by one or both of the arms. In some embodiments the arm comprising the heating zone may comprise a resiliently flexible portion and a portion which supports the heating zone. In this way, the portion supporting the heating zone may not flex to avoid any undue pressure on the heating zone which may be formed from a heatable plate for example.

The arms and the shoulder may be integrally formed from the same sheet material or member. In other words, both arms and the shoulder may be formed from a single piece of material, without joins, by pressing, i.e. shaping, the material into the desired shape. In variants the arms and shoulder may be formed from a solid block of material, such as aluminium, which is machined to form the integral arms and shoulder. In other variants, the arms and shoulder may be integrally formed by injection moulding with plastics.

In the hair styling apparatus, the shoulder may be arranged to form a maximum 45 degree angle between the opposed ends of the arms when in the open position such that there is a gap to allow a quantity of hair to be styled to be inserted between the arms. In many embodiments this angle may be narrower, for example in the range of 20 to 30 degrees.

The hair styling apparatus may further comprise a housing which may be used to encase components, such as the control electronics and heater elements for the heating zones etc. In some embodiments the housing (shell) may be sufficiently strong that no chassis is needed and other components of the styling apparatus may be supporting by the housing, including the heating zones for example. However, in other embodiments the arms and the shoulder may form a resiliently flexible chassis for the hair styling apparatus. This chassis may then be used to support the housing and any other components of the styling appliance that need securing, such as a heatable plate in the heating zone.

In the hair styling apparatus a resiliently flexible portion of the least one arm or shoulder may comprise a generally oval cross-section. This oval cross-section is particularly useful at minimising yaw. In variants however, such a chassis may be formed from a generally flat member bent at the shoulder to form the two opposing arms.

In embodiments where a resiliently flexible chassis is used within a housing, this oval cross section may extend along the entire chassis, extending through the arms and the shoulder in order to minimise yaw across the entire length of the chassis. However, the housing may take on various shapes and cross-sections allowing more design freedom.

In embodiments one or more of the arms or the shoulder may be formed from metal, such as aluminium, or formed from plastic, or a combination of both. In embodiments where both arms and shoulder are integrally formed it will be appreciated that the same material will be used, however further features, such as housing sections, may be formed from any suitable material (metal or plastics for example) which are then coupled to the integrally formed arms and shoulder. This may be the case when the arms and shoulder are integrally formed as a chassis to which further housing components may be attached.

The heating zone may comprise a heatable plate. Such a heatable plate, when used for hair straightening, may be a flat plate.

The hair styling apparatus may comprise a heatable plate retained on a resilient suspension. This resilient suspension allows the heatable plate to move (pivot forwards, backwards, side to side), improving contact with a quantity of hair held between the arms of the styling appliance. The resilient suspension may also retain, i.e. hold, the heatable plate eliminating the requirement to affix the heatable plate to the arm by other couplings.

The resilient suspension may comprise a flexible substrate supported by the at least one of the arms. This flexible substrate may retain/secure the heatable plate, the flexible substrate may then be further attached to the arm to hold the heatable plate and suspension assembly in place. This substrate may be positioned at least under the heatable plates to further provide thermal insulation and may also extend to the sides of the heatable plate to improve retention of the heatable plate. The flexible substrate/resilient suspension may comprise a flexible rubber such as a flexible silicone rubber.

One or both of the arms may comprise a heating zone in order to improve heat transfer into the hair to be styled. Such heating zones may oppose one another such that the quantity of hair to be styled is heated from both sides of the styling apparatus at the same time.

In some embodiments each of the arms may be generally elongate. The heating zones may then extend along at least part of the length of the arm to provide a region on which a quantity of hair can be heated.

The hair styling apparatus may be powered from battery or be mains powered. In embodiments the mains powered source may provide a DC voltage to the apparatus or alternatively the apparatus may be powered from AC power directly.

The battery power source may be user removable from the hair styling apparatus, and may be in the form of a battery power pack, or individual battery cells. In either case, the fact that the battery source is removable by a user means that the battery source is readily interchangeable. A user may for example have more than one battery power pack that can easily be swapped when it runs flat.

In other embodiments however, the battery power source may be user non-replaceable. Such embodiments may allow for further design freedom through the use of different battery configurations, enable a better weight distribution in the apparatus and may allow for more aesthetically pleasing hair styling apparatus designs.

In one embodiment, the heating zones of the first and second arms may be adjacent each other when the arms are in the closed position. The shoulder may be configured to minimise misalignment between the heating zones when the arms are in the closed position.

According to another aspect of the invention there is provided a hair styling apparatus comprising: a first arm and a second arm joined at one end by a shoulder, wherein the first and second arms are movable between an open position in which the opposed ends of the arms to the shoulder are spaced apart and a closed position in which the opposed ends of the arms are brought together, and each arm comprises a heating zone; wherein the heating zones are adjacent each other when the arms are in the closed position; wherein the shoulder is configured to minimise misalignment between the heating zones when the arms are in the closed position.

At least one of the arms or the shoulder may be resiliently flexible to allow the arms to move between the open and closed position. At least one of the resiliently flexible arms or shoulder may be arranged such that first and second arms are biased apart in the open position and then urged to the closed position by a user squeezing the arms together. The fact that the shoulder is configured to minimise misalignment means that when a user squeezes the arms together, the heating zones are brought together.

The shoulder may be reinforced to reduce yaw of the arms relative to one another. This means that in general use, it may be harder to unintentionally induce misalignment.

The shoulder may have a thicker cross-section than that of the arms in order to minimise misalignment. Such a thicker cross-section may also provide reinforcement.

The shoulder and arms are may be made from a composite material, such as carbon fibre for example. To minimise misalignment, the shoulder may comprise at least one extra layer of composite material in order to increase the rigidity/strength of the shoulder. It will be appreciated in variants that the arms may comprise more layers than necessary of composite material if a consistent thickness of the housing is preferred.

The shoulder may comprise a generally straight inner edge and a generally curved outer edge. In this way, the shoulder may be thicker in parts because the outer edge curves, thereby minimising misalignment.

Additionally or alternatively, the shoulder may comprise a reinforcement member to minimise misalignment. Such a reinforcement member may formed integrally with the shoulder. The reinforcement member may project inwards between the two arms to increase the thickness of the shoulder in regions to minimise misalignment. Such a reinforcement member may comprise at least one cross brace and/or a chamfered projection.

The shoulder may be a shoulder assembly. It will be appreciated that the shoulder assembly may be integrated in the hair styling apparatus. Alternatively the shoulder assembly can be a modular component which may be used with various types of hair styling apparatus. The detailed features of such a shoulder assembly are set out below.

According to one aspect of the invention, there is provided a shoulder assembly for connecting two arms of a hair styling apparatus, the shoulder assembly comprising:

a housing;

a first coupling member which is attached to the housing and which projects from the housing to couple the housing to a first arm;

a second coupling member which is attached to the housing and which projects from the housing to couple the housing to a second arm;

wherein both the first and second coupling members are flexible so that the first arm is movable relative to the second arm when the shoulder assembly is connected to the first and second arms.

The shoulder assembly is a modular component which may be used with various types of hair styling apparatus (and may also be used with other devices having two arms). The hair styling apparatus may be a straightener, a crimping iron or a curling apparatus with the first and second arms correspondingly adapted. Typically, at least one, preferably both, of the first and second arms may comprise a heating zone for heating hair which is in contact with the heating zone. The arms may be movable between an open position in which the opposed ends of the arms to the shoulder assembly are spaced apart and a closed position in which the opposed ends of the arms are brought together. In the open position, hair may be positioned between the two arms so that it is styled when the two arms are brought together.

The first and second coupling members may be in the form of springs, preferably flat springs. The springs may be made from spring steel. The thickness of the spring may be between 0.3 mm and 1.5 mm. The thickness of the spring determines the force required to move the arms relative to one another. For example, for the thickness range above, the closing force of two arms may be between 0.48N and 24.5N.

Each spring may be in tension whereby the first and second arms are biased in a first position when the shoulder assembly is connected to the first and second arms. The first position may be an open position in which the opposed ends of the arms to the shoulder assembly are spaced apart. In this way, the shoulder assembly is configured to ensure that the arms are open fully when the arms are in the open (rest) position.

Each spring may comprise a first and a second portion and the tension in each spring may be adjusted by setting a displacement angle between the first portion and the second portion. The displacement angle may be between 10 to 20 degrees.

The housing may comprise a flange which projects from the housing adjacent at least one of the first and the second coupling members to maintain a constant angle between the housing and the at least one of the first and second coupling members. The housing may comprise a pair of flanges; one for each of the first and second coupling members. If each spring is in tension, the pre-tensioned angle of the spring may not be the correct angle to bias the first and second arms in the correct open position. The flanges may adjust the pre-tensioned angle of the spring to the correct angle.

At least one of, preferably both of, the first and second coupling members may comprise a damping component. The damping component may be a coating which may be applied to one side of the coupling member. If a user releases the styler arms quickly from the closed position, the arms are likely to experience simple harmonic motion. The oscillations do not affect the operation of the hair styling apparatus. However, the user's perception of the quality of the product may be compromised. The damping component reduces the oscillations.

The shoulder assembly may comprise at least one arm travel stop which is configured to prevent excessive movement of the first arm relative to the second arm when the shoulder assembly is connected to the first and second arms. For example, the rest position is the open position but it is preferable to prevent a user from opening the arms further apart. The arm travel stop may prevent such movement. The at least one arm travel stop may comprise an aperture which is engageable with a protrusion on the first or second arm. The at least one arm travel stop may be attached the first or second coupling member. In this way, if the user attempts to open the styler arms past their natural open state, the protrusion contacts the coupling member and restricts further movement of the styler arms.

Each of the first and second coupling members may comprise a first portion which is mounted within the housing and a second portion which projects from the housing for connection to the corresponding arm. At least the second portion may be flexible. The first and second portions may be joined by a joint which acts as a hinge line. Thus, the flexing of the coupling members which permits the arms to move relative to one another may be about the hinge line and/or within the second portion itself (i.e. the material of the coupling member bends). In this way, each coupling member may be considered to be undergoing a similar motion to a diving board.

The housing is rigid. The housing may be formed of a rigid metal such as cast aluminium, or from a rigid plastic or ceramic. The rigidity of the housing allows restriction of the yaw rotation of the arms of the hair styling apparatus, and also provides a strong, rigid housing for the electrical connections. The shoulder assembly may further comprise an electrical connector which is connectable to electrical components within the first and second arms.

For a rigid housing, no movement of the shoulder assembly occurs when the arms are moved relative to each other (and relative to the shoulder assembly). It will thus be appreciated that if the arm and housing were in contact at the open (rest) position, moving the arms together would open up a gap at an upper surface. Moreover, the contact at the bottom surface may prevent or inhibit a user from closing the arms. Accordingly, it may be necessary to include a gap between the arm and the housing of the shoulder assembly at a lower surface. Such gaps would be unsightly and may also allow debris to enter the device which is not desirable. The shoulder assembly may further comprise a first transition component which is connected to the housing and which is connectable to the first arm and a second transition component which is connected to the housing and which is connectable to the second arm. The first and second transition components are preferably configured to maintain a generally smooth or continuous surface between the housing and each arm when the first and second arms are moved relative to each other.

The transition components may be integrally formed with the housing of the shoulder assembly or may be separate components. The first and second transition components may be separate components or may be connected by a substrate to form a single transition assembly which may ease manufacture. The transition components are preferably flexible so that they expand/contract to provide a smooth or continuous surface with minimal gaps between the transition component and the shoulder assembly and the transition component and the arm respectively. Each transition component comprises connectors which couple the transition component to the shoulder assembly and arms respectively.

The first and second transition components may comprise a rigid substrate and a flexible joint which may be formed using a co-injection process. The rigid substrate may form a sleeve which houses the flexible joint. The flexible joint connects the connectors which couple the transition component to the shoulder assembly and arms respectively. Alternatively, the first and second transition components may be formed from a single continuous elastomeric material. The first and second transition components may be in the form of sleeves.

The housing is preferably rigid to minimise yaw. However, there may be styling apparatus (or other apparatus) where some yaw is desired between the arms. Accordingly, the first and second coupling members may be configured to provide yaw between the first and second arms when the shoulder assembly is connected to the first and second arms. For example, the first and second coupling members may be in the form of swan-necked springs, i.e. a spring comprising a curved joint. A depth of the swan neck (curved joint) may be configured to provide yaw.

According to a further aspect of the invention there is provided a method of making a hair styling apparatus according to the first aspect of the invention, comprising pressing a sheet material to integrally form the first arm and the second arm joined at one end by a shoulder. In other words, both arms and the shoulder may be formed from a single piece of material, without joins, by pressing, i.e. shaping, the material into the desired shape. This may be done in one or multiple pressing steps, for example one approach may be first press the material to form both arms either side of a centre shoulder then curve the pressed material about the shoulder region to curve one arm back over the shoulder region such that it then opposes the other arm.

According to a further aspect of the invention there is provided a hair styling apparatus comprising a pair of arms, at least one carrying a heater, having a shoulder at one end, biased open, and closeable under manual pressure, wherein said arms and said shoulder define a continuous strip forming a convex curve around said shoulder, and wherein said arms are closeable by flexing said continuous strip.

By introducing a flex into the continuous strip forming the arms and shoulder (hinge), no separate pivoting mechanism is required, eliminating components need to allow such pivoting meaning that the space can be put to further use (for example, increasing battery space) or the styling apparatus can be made lighter or smaller. In use, a user applies a manual pressure, squeezing the arms together about a quantity of hair to be styled. Resiliency in the continuous strip allows the arms to return to the open position once a user has released the arms. This means that no further biasing means (e.g. spring) are required to force the arms apart.

According to a further aspect of the invention there is provided a heatable plate assembly for a hair styling apparatus, the heatable plate assembly comprising a heatable plate and a resilient suspension arranged to support the heatable plate, wherein the resilient suspension comprises a flexible substrate arranged to retain the heatable plate; and wherein the resilient suspension is adapted to be attached to the hair styling apparatus. Such a resilient suspension may comprise a flexible rubber such as a flexible silicone rubber.

The fact that the flexible substrate retains the heatable plate means that the heatable plate is retained by the flexible substrate without need to further secure the heatable plate to any part of a housing or chassis of a hair styling apparatus. This reduces component count and reduces assembly time and complexity. Furthermore, such a flexible substrate, in particular one made of a flexible silicone rubber may also have thermal insulation properties beneficial to such a heatable plate assembly fitted into a hair styling appliance, reducing or eliminating the requirement for further insulation materials allowing for thinner and/or lighter styling apparatus.

According to a further aspect of the invention there is provided a method of making a heatable plate assembly as described above, comprising providing a heatable plate and injection moulding the resilient suspension to the heatable plate. By injection moulding the resilient suspension to the heatable plate the heatable plate is retained by the resilient suspension without any further securing means. The resilient suspension may then be attached to an arm of a hair styling apparatus without needed to further secure the heatable plate by any other means.

According to a further aspect of the invention there is provided a hair styling apparatus comprising the heatable plate assembly described above.

BRIEF DESCRIPTION OF THE DRAWINGS

For a better understanding of the invention and to show how it may be carried into effect reference shall now be made, by way of example only, to the accompanying drawings in which.

DETAILED DESCRIPTION OF THE PREFERRED EMBODIMENTS

As described above, FIGS. 1*b* and 1*b* show a typical hair straightener 1 and a typical hair crimper 10. Such hair styling devices or other typical hair styling devices may be adapted to use the following features described below.

Figure 3A:
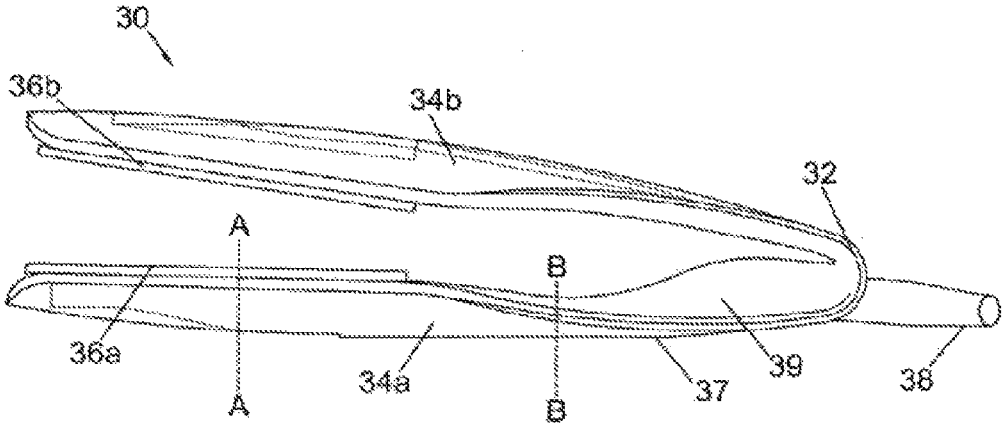
FIG. 3*a* shows one embodiment of the hair styling apparatus according to an aspect of the present invention.
Figure 3B:
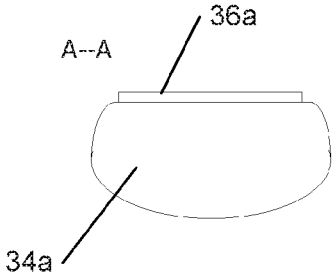
FIG. 3*b* shows a cross-section on line A-A of the hair styling apparatus of FIG. 3*a;*
Figure 3C:
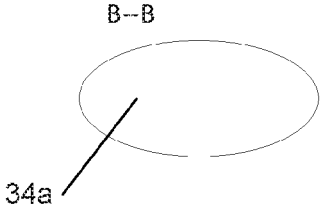
FIG. 3*c* shows a cross-section along line B-B of the hair styling apparatus of FIG. 3*a;*

FIGS. 3*a-c* show an example embodiment of a hair styling apparatus 30 in an open position ready to receive a quantity of hair for styling. In this embodiment the apparatus forms a hair straightener using flat heatable plates 36*a* and 36*b*.

Referring first to FIG. 3*a*, this shows a side view of the hair styling apparatus 30. The styling apparatus has two arms 34*a*, 34*b*, arranged so that when squeezed together the heatable plates 36*a*, 36*b* positioned on each arm 34*a*, 34*b* come into contact.

In this embodiment, the conventional pivot mechanism is eliminated from shoulder 32 on FIG. 3*a*. Instead, the arms and shoulder (the region at which the arms join) form a continuous strip and one or both of the arms or the shoulder are resiliently flexible such that the styling apparatus can move from the open to the closed position by flexing a portion of the styling apparatus itself. In FIG. 3*a*, the arms are biased open to allow a section of hair to be inserted between the heatable plates. To close the arm sections, a user squeezes the arms together which causes one or more of the arms and/or the shoulder 32 to flex and move the heater plates together. Relaxing a hold on the arms then allows the arms to flex or spring apart back to their resting position. In this way, the arms and shoulder act much like an arc shaped leaf spring. The skilled person will appreciate that the shoulder forming the intersection between the two arms need not be curved/arced, instead having one or more corners and straight edges.

In the embodiment shown in FIG. 3*a*, the arms are formed from a flexible metal shell/housing 37 that acts as a structural skin or exoskeleton for the styling apparatus, eliminating the need for a separate chassis for the styling apparatus. This shell is formed from a single piece of material shaped to form a first arm 34*a* which then turns (e.g. by arcing) via shoulder 32 back on itself to form a second arm 34*b* that opposes the first arm 34*a*. In this way the both arms are formed from a single structural element that allows for a flexing/springing motion of the arms towards and away from one another. In variants a portion of the arms are formed from a material shaped to form a structure comprising sections of both opposing arms and the shoulder 32. Should the arms need to be longer, they may then be completed by attaching further members to this structure.

Forming the styling apparatus in this way significantly reduces the undesired play in a pivot mechanism between the two arms as there are no separate component joints or component couplings that may lead to undesired yaw or roll.

FIG. 3*c* shows a cross-section through the region of lower arm 34*a* marked by dotted line 'B-B' in FIG. 3*a*. The arms may have a generally oval shaped cross-section which further reduces any yaw or roll of the arms. The same general cross-sectional shape may also be used on the upper arm in all regions but that having the heatable plate and may further extend through the shoulder region 32.

As can be seen in FIG. 3*b*, in the region of the lower arm marked by dotted line 'A-A' in FIG. 3*a*, the outer shell also retains part of the oval shape to minimise yaw and/or roll, but the opposing side is generally flat to allow the heatable plate to be mounted. In variants the shell/housing may have a generally flat ribbon like cross-section in one or more positions, in particular around the arcuate shoulder 32.

The shell/housing 37 may be machined from a single piece of metal, cast, or shaped/bent from a sheet material to form the arrangement of FIG. 3*a*. Such techniques are particularly relevant to working with metals. One such preferred metal to use is aluminium or springed steel. Springed steel having a thickness in the range of 0.5 mm to 2 mm may be used, with a thickness of approximately 0.8 mm experimentally shown to provide an acceptable closing force. Plastics may also be used to form such a flexible but strong shell. Depending on the particular plastic material, the plastic may have a thickness in the range of 2-8 mm, more preferably 3-5 mm. In such a variant the shell may be formed by injection moulding for example. In such an embodiment the shell/housing 37 may then provide support other components of the styling apparatus. These may include the control and drive electronics and the heatable plates etc. Further housing components (for example reference 39 in FIG. 3*a*) to cover the control and drive electronics may also be secured to the main curved and flexible housing shell/housing. As depicted in FIG. 3*a*, these additional housing components may be formed from plastics, (but metals may also be used) and cover regions of the styling apparatus on each arm facing the opposing arm (i.e. providing a further shell portion). A void is then formed between the outer shell 37 and these additional housing components in which the control and plate drive electronics may be positioned. It will be appreciated that in some embodiments this further shell portion may also need to flex in one more regions to allow the styling apparatus to flex to close and open.

In some embodiments it may be further possible to construct the entire casing from a single piece of machined metal or injection moulded plastic, i.e. in effect providing a 'unibody' design. The remaining components (heatable plates, control and drive electronics etc.) may then be inserted into the styling apparatus through the heatable plate sockets or through an aperture formed for the power socket 38. In this way, component counts may be reduced and a more aesthetically pleasing design may be formed.

Figure 2A:
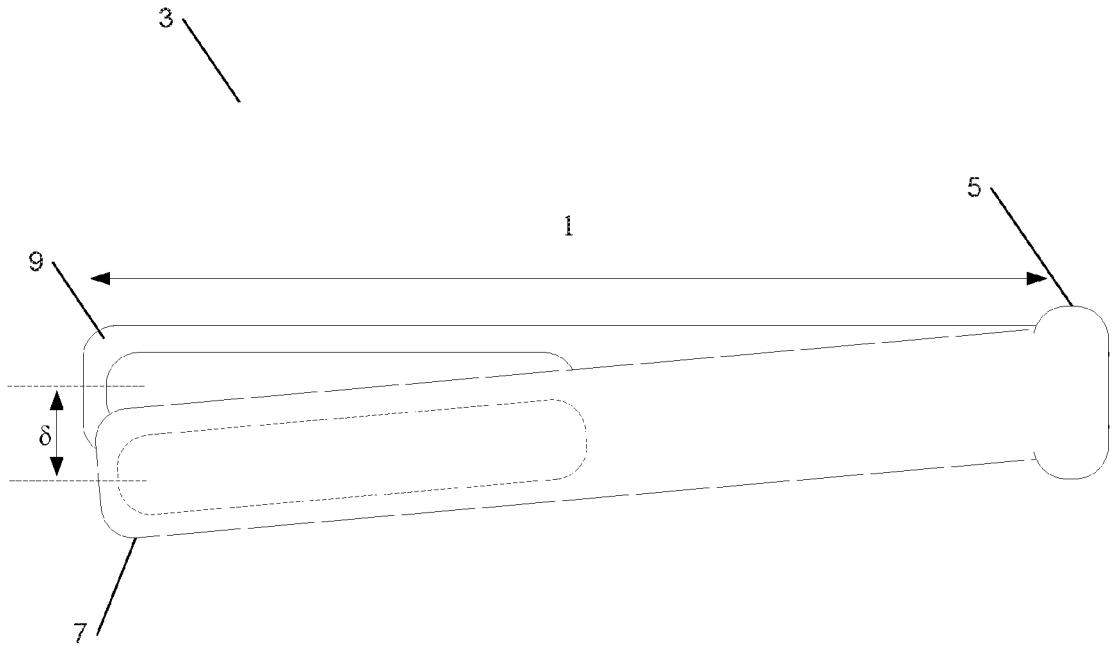
Figure 2a (prior art)
FIGS. 2*a* and 2*b* shows the effect of yaw in hair styling apparatus of the prior art.
Figure 2B:
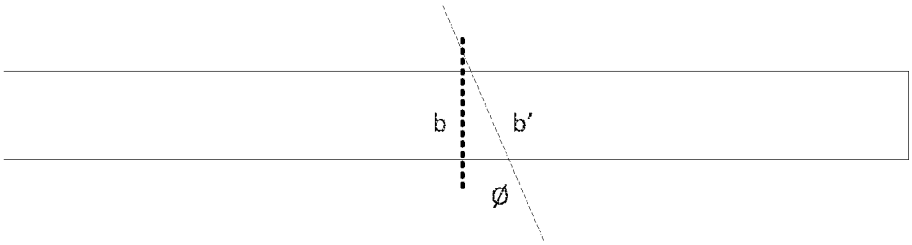
Figure 2b (prior art)

Referring now to FIGS. 4*a*-4*j* these show variants of the shoulder 32 of FIG. 3*a* of the styling apparatus. In each case, the shoulder has been configured to minimise yaw by constraining movement at the shoulder. Referring to FIGS. 2*a* and 2*b*, the tip deflection 8 which occurs as a result of yaw is given by:

$$\partial = l \tan \phi$$

Where l is the length of the arm and $\phi$ is the yaw angle, i.e. the angle between the bending axis shown in FIG. 2 and the correct bending axis in which there is no yaw. $\phi$ may also be considered to be the angle of rotation of the bending axis away from the true axis.

The force F required to bring the arms together is defined by:

$$F = \frac{Ebd^3}{12r^2\cos\phi}$$

Where E is the modulus of elasticity of the material for the arm/shoulder, b is the width of the arm, d is the thickness of the material and r is the radius of curvature at the shoulder.

There are various ways to increase the yaw stiffness, including increasing the stiffness of the material, increasing the thickness of the material or reducing the radius of curvature, perhaps even to eliminate the radius of curvature. In essence, the aim is to configure the shoulder to restrain rotation of the axis of bending.

Figure 4A:
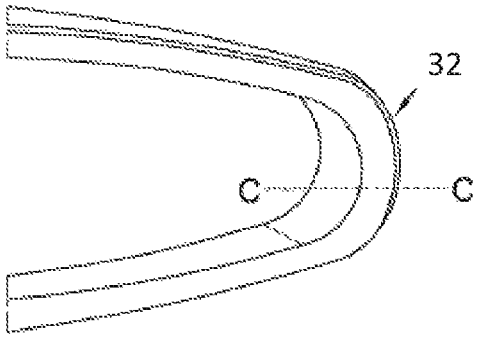
FIGS. 4*a*-4*j* show variants of one part of the hair styling apparatus of FIG. 3*a;*
Figure 4B:
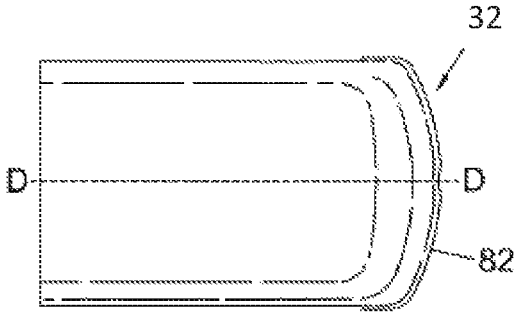
Figure 4C:
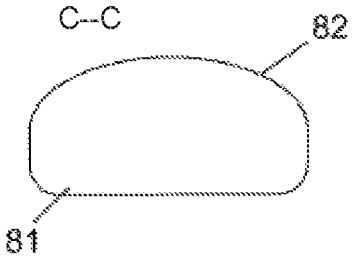
Figure 4D:
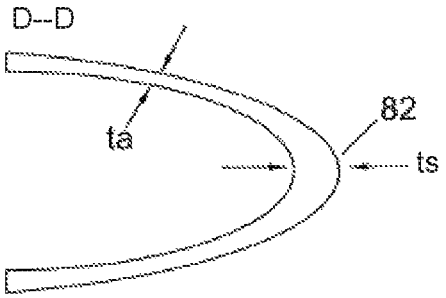

FIGS. 4*a* to 4*d* show a first variant of the shoulder which has been configured to minimise yaw. This has been achieved by reinforcing the shoulder by forming the shoulder with a thicker cross-section relative to the cross-section of the arms (or portion of the arms which is formed integrally with the shoulder). As shown FIG. 4*c*, showing a cross section from one side of the shoulder to the other along line C-C, the shoulder has a generally straight inner edge 81 and a curved outer edge 82. By inner edge, it is meant the edge which is between the pair of arms. Thus, as shown in FIG. 4*b*, the centre of rear face of the shoulder projects away from the arms. In this way, the shoulder can be thickened, whilst still appearing from the sides to be a similar thickness to the arms. This is shown in more detail in FIG. 4*d*, showing a cross section along dotted line D-D of FIG. 4*b*. The thickness (ts) of the shoulder is greater than the thickness (ta) of the arms. The shoulder is thus generally rigid and its ability to act as a hinge between the arms is reduced.

Figure 4E:
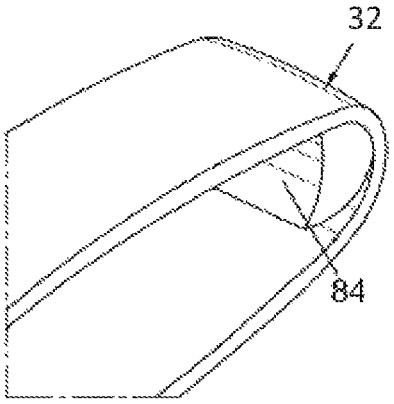
Figure 4F:
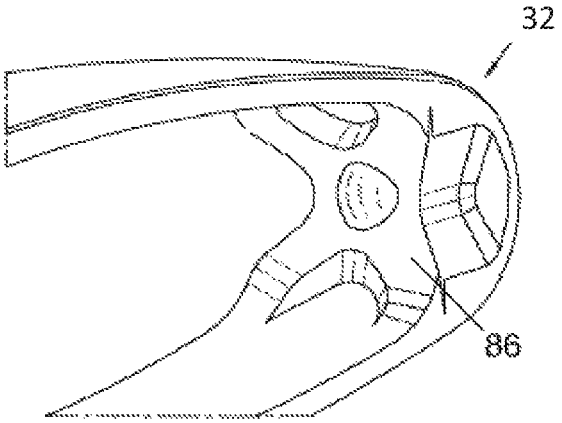

FIGS. 4*e* and 4*f* show alternative variants of the shoulder which have been configured to minimise yaw. In both cases, the shoulder comprises a reinforcement member which projects inwardly between the arms. The reinforcement member means that the shoulder is thicker than the arms to improve provide rigidity and minimise yaw. Much like the embodiment shown in FIGS. 4*a*-4*d*, the shoulder has regions that are thicker than the arms. In these variants, the shoulder may not flex, or may only flex a little, although it will be appreciated that the level of flex will be dependent on the thickness of the shoulder. Thus, the shoulder is not really a hinge and thus one or both of the arms needs to be resiliently flexible to allow the heatable plates to come together and clamp a section of hair.

In FIG. 4*e*, the shoulder comprises a solid projection 84 which fits within the arcuate region defined between the arms and shoulder and has a matching shape. The projection 84 has chamfered sides to provide a more aesthetically pleasing design. The chamfered sides also reduce the thickness towards the edges of the shoulder and arms to reduce the weight of the styling apparatus. In FIG. 4*f*, the reinforcement member 86 is generally X-shaped and thus comprises a pair of cross braces.

Merely as an illustration, for a pair of arms and shoulder integrally formed from a sheet of steel having a thickness of 0.8 mm, the force required to close the arms is approximately 2.25N and the yaw stiffness is approximately 0.3 N/mm. The use of a cross-braced reinforcement member in the same arrangement decreases the closing force to approximately 2N and increases the yaw stiffness to approximately 0.7 N/mm. By contrast, increasing the thickness of the steel to 1.0 mm without including a reinforcement member increases the closing force to approximately 3.6N and increases the yaw stiffness to approximately 0.5 N/mm and increasing the thickness to 1.5 mm increases the closing force to approximately 11N and increases the yaw stiffness to approximately 1.5 N/mm. Thus the use of a reinforcement member significantly improves the yaw stiffness without making it more difficult for a user to close.

In both FIGS. 4*e* and 4*f*, the reinforcement member may be integrally formed with the shoulder/arms or may alternatively be a separate element secured to the shoulder region during manufacture. For example, the cross brace of FIG. 4*f* may be formed from a different material to the shoulder region e.g. a metal cross brace could be coupled to a plastic or composite shoulder. Where a separate reinforcement element is used, such a member may be enclosed or encased for aesthetic or similar considerations.

Both the embodiments of FIGS. 4*a* and 4*f* show a central aperture within the shoulder. This aperture may allow for the connection of one or more wires to power the heatable plates or for connection of a charging cable to recharge a battery powered variant, as appropriate. Similar provision may be made in all embodiments.

In all of the arrangements of FIGS. 4*a* to 4*f*, the shoulder 32 has a width which is less than or the same as the width of the arms. The width is the distance between the left side and right side of one arm, i.e. the lateral distance. In other words, the shoulder does not extend laterally beyond the arms and is in line with the arms to provide an enhanced visual impression.

Figure 4G:
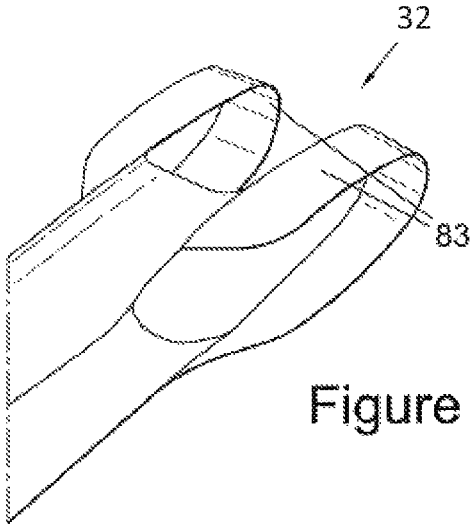
Figure 4H:
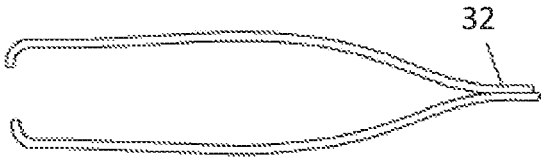

FIGS. 4*g* and 4*h* shows furthers variant of the shoulder in which the shoulder is reinforced by extending (e.g. widening, lengthening or both) to minimise yaw. In the example of FIG. 4*g*, the shoulder is wider than the arm (or portion of arm) with which it is integrally formed. The shoulder is also longer than the shortest curve required to join the two arms (or portions of the arms) together and thus the shoulder has also been lengthened. In FIG. 4*g*, the shoulder comprises two members 83 separated by a gap. Each member is in the form of a continuous strip having a pair of planar sections each of which extend generally parallel to the corresponding arm to which they are connected and a curved section linking the pair of planar sections. The gap may allow for connection of one or more wires to power the heatable plates or for connection of a charging cable to recharge a battery powered variant. In this embodiment, the width of the gap is generally similar to the width of the arm and thus each member is attached to the side of the arms. It will be appreciated that the size of the gap may be varied but still allow connections through the gap. If the gap is small enough, the members 83 will be closer together and the shoulder may be of a similar width to the arms.

Merely as an illustration, for a pair of arms and shoulder integrally formed from a sheet of steel having a thickness of 0.8 mm, the arrangement of FIG. 4*g* decreases the closing force to approximately 2.5N and increases the yaw stiffness to approximately 0.75 N/mm when compared with a simple curved shoulder. Thus reinforcement using extensions also improves the yaw stiffness without making it more difficult for a user to close.

FIG. 4*h* shows a variant of the apparatus having a "tweezer" style arrangement. Each arm forms a lever and is joined together at a fixed end which forms the shoulder 32 or fulcrum point for each lever. In this variant of FIG. 4*h*, the arms (or a portion of the arms) are not formed integrally with the shoulder from a continuous strip of material. Each arm is formed as a separate piece which is joined to the other at one end, e.g. by gluing, welding, riveting, bolting or by other known mechanisms which result in a fixed end. As an alternative, the shoulder could be formed integrally with the arms, e.g. by comoulding a fixed shoulder section from which extend two flexible arms. In the embodiment of FIG. 4*h*, each arm comprises two generally parallel planar sections joined by an angled section to from a generally "S" shape. The two arms are joined to one another along one planar section. The fixed connection provides rigidity at the shoulder (join region) and prevents yaw.

Figure 4I:
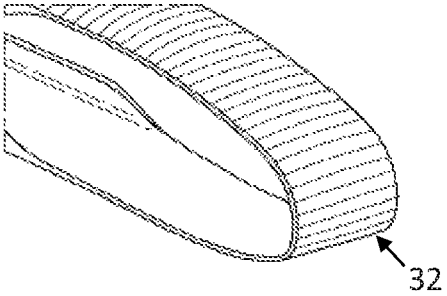
Figure 4J:
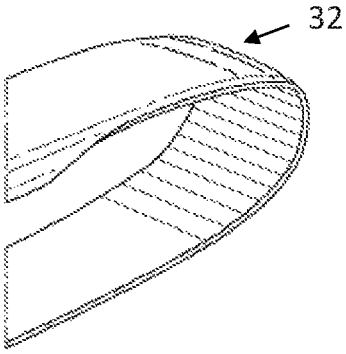

FIGS. 4*i* and 4*j* show two embodiments in which the shoulder is reinforced by providing ribs which extend across the width of the shoulder. In the embodiment of FIG. 4*i*, the ribs are provided on the external surface of the shoulder and in FIG. 4*j*, the ribs are provided on the internal surface of the shoulder. As in previous embodiments, the width of the shoulder does not extend beyond the width of the arms.

Figure 6A:
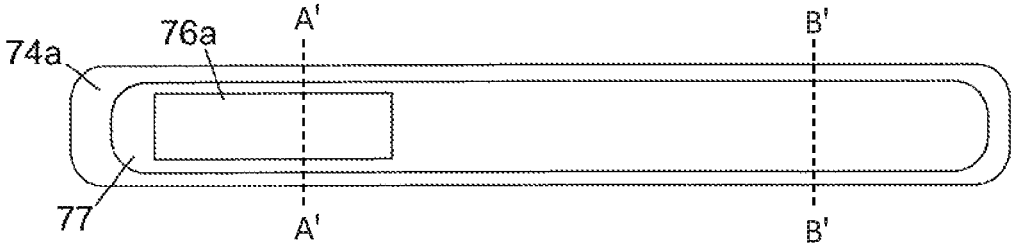
FIG. 6*a* shows a top down view of one arm from a variant of the hair styling apparatus of FIG. 3*a;*
Figure 6B:
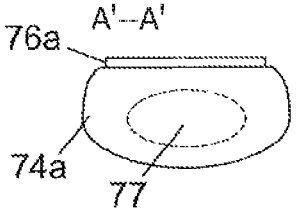
FIG. 6*b* shows a cross-section through a portion of the hair styling apparatus arm of FIG. 6*a;*
Figure 6C:
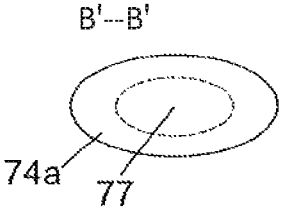
FIG. 6*c* shows a cross-section through a portion of the hair styling apparatus arm of FIG. 6*a;*

In other embodiments, an example of which is shown in FIGS. 6*a* to 6*c*, a flexible member may be used to form a flexible chassis which is shaped to form both arms and the shoulder between the arms, again without a pivot mechanism. FIG. 6*a* shows a top down view of one arm from a variant of the hair styling apparatus of FIG. 3*a*. In FIG. 6*a*, apparatus arm 74*a* comprises a heatable plate 76*a* and a chassis member 77 within the arm 74*a*. FIG. 6*b* shows a cross section through the portion of the arm retaining the heatable plate (through the line A'-A' in FIG. 6*a*) and FIG. 6*c* shows a cross section through another portion of the arm where there is no heatable plate (through the line B'-B' in FIG. 6*a*). FIGS. 6*b* and 6*c* further show that the chassis may have a generally oval cross section to reduce play between the arms as previously discussed with reference to FIG. 3*c*. Using such a chassis member may allow for a more lightweight shell/casing to be used. In this way, the shell may not be structural, instead being mounted onto this flexing chassis member. Such a shell or housing may then be customised or provided in many different colours or materials without any need to modify the chassis.

In variants of the chassis shown in FIGS. 6*a* to 6*c*, the chassis may be formed from a generally flat ribbon like member shaped to form the opposing arms from a continuous piece of material.

Figure 7:
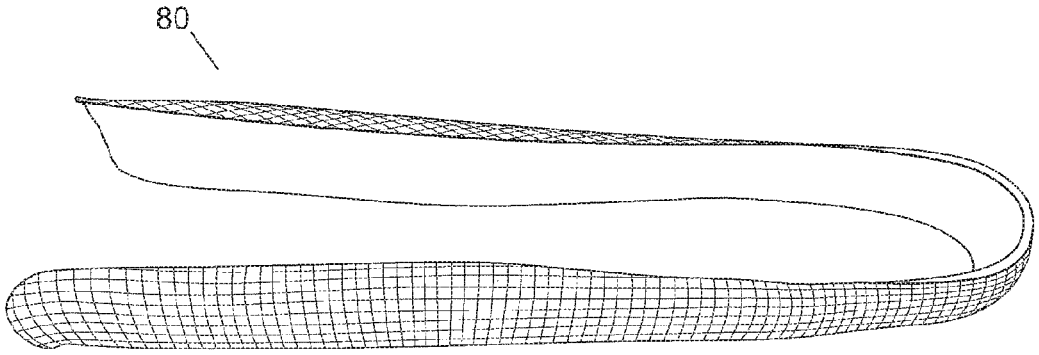
FIG. 7 shows a further arrangement of the hair styling apparatus formed from carbon fibre.

In further variants, such as shown in FIG. 7, the casing or chassis may be formed from composite materials such as carbon fibre to provide a robust and lightweight styling apparatus. In other variants, component parts of the styling apparatus may be formed from carbon fibre, with other plastic and/or metal elements used to form the casing or chassis. One advantage of using carbon fibre or a similar woven material is that the weave may be modified to change the strength of the material in each direction, e.g. one direction may have a higher strength to assist in preventing yaw.

Multiple layers of carbon fibre may be used to provide suitable rigidity whilst allowing the arms to flex, for example between two to five or more preferably two to three layers may be used. Where composites such as carbon fibre are used, it may be necessary to reinforce the shoulder. This may be achieved as described above or by using additional layers of material at the shoulder. For example, there may be at least one, perhaps between two or four extra layers at the shoulder. Thus, the embodiment of FIG. 7 shows a chassis comprising three layers of carbon fibre weave of 232 g in each arm and seven layers of the same material at the shoulder. The cross-sectional shape is generally oval as described in relation to FIG. 3*c* but it will be appreciated that this can be altered.

Merely as an illustration, it is noted that an arrangement similar to that of FIG. 7 with four layers in each arm and six layers at the shoulder was too stiff for a user to close. If the number of layers was reduced to three layers in each arm and four layers, the balance between force required to close the arms and yaw performance is significantly improved. Reducing the layers still further to two layers in each arm and four layers at the shoulder meant that the yaw performance was poor.

The embodiment of FIG. 3*a* is powered by an external power supply which may be connected via power connector 38. The styling apparatus may be operate on AC or DC voltage. DC powered embodiments may use an AC to DC external power supply that can convert AC mains (normally at 230V or 110V) to a DC power supply.

Figure 5:
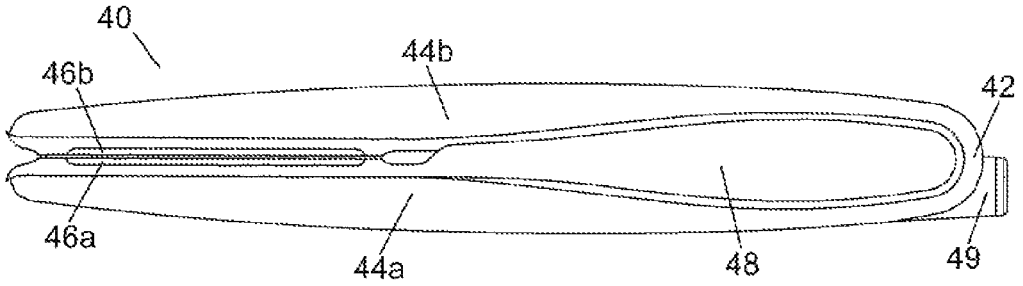
FIG. 5 shows another embodiment of the hair styling apparatus according to an aspect of the present invention.

FIG. 5 shows a variant of the hair styling apparatus of FIG. 3*a* that can operate from a battery power supply. In FIG. 5, this embodiment of the hair styling apparatus is shown in a closed position with the heatable plates 46*a* and 46*b* in contact with one another. In use, a user squeezes arms 44*a* and 44*b* together to clamp the heatable plates about a quantity of hair. Clamped closed as shown in FIG. 3*a*, one or both of the arms are under tension. When the arms are released, the arms separate and the styling apparatus returns to its resting position with the arms spaced apart.

In the embodiment of FIG. 5, a battery chamber 48 is used to store one or more batteries allowing for cordless styling by a user. In FIG. 5, battery chamber 48 is integrally formed into the lower arm 44*a*, allowing the upper arm 44*b* to flex away from shoulder point 42. This chamber may be styled so that when the arm are squeezed together, as shown in FIG. 5, the battery chamber is flush with the upper arm 44*b*. In variants however it will be appreciated that chamber 48 may be a replaceable unit that slots into the lower arm, providing a user replaceable power unit. Such a unit having a housing with battery cells integrated may allow tighter packing of the battery cells into the chamber to increase the overall stored charge compared to conventional cylindrical cells.

Figure 1A:
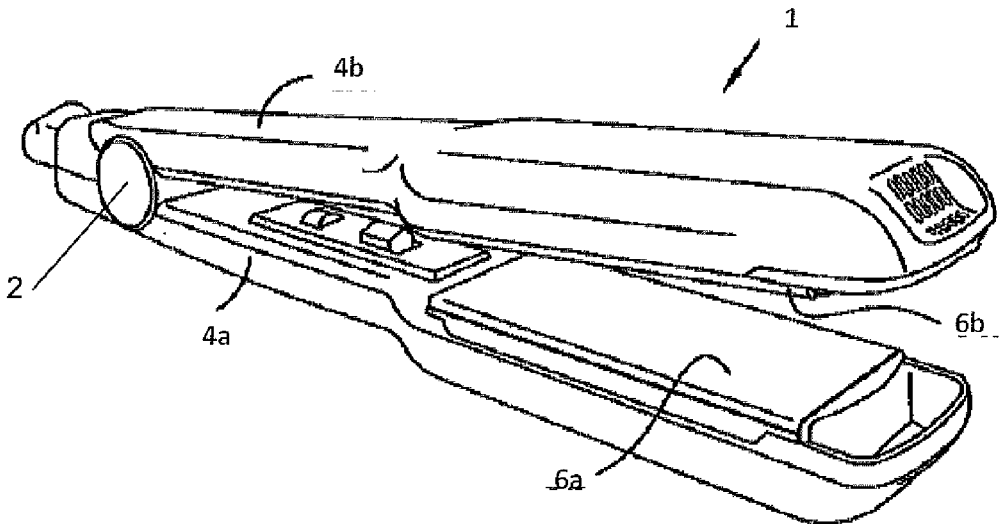
Figure 1a (prior art)
FIG. 1*a* shows an example of hair straighteners according to the prior art.
Figure 1B:
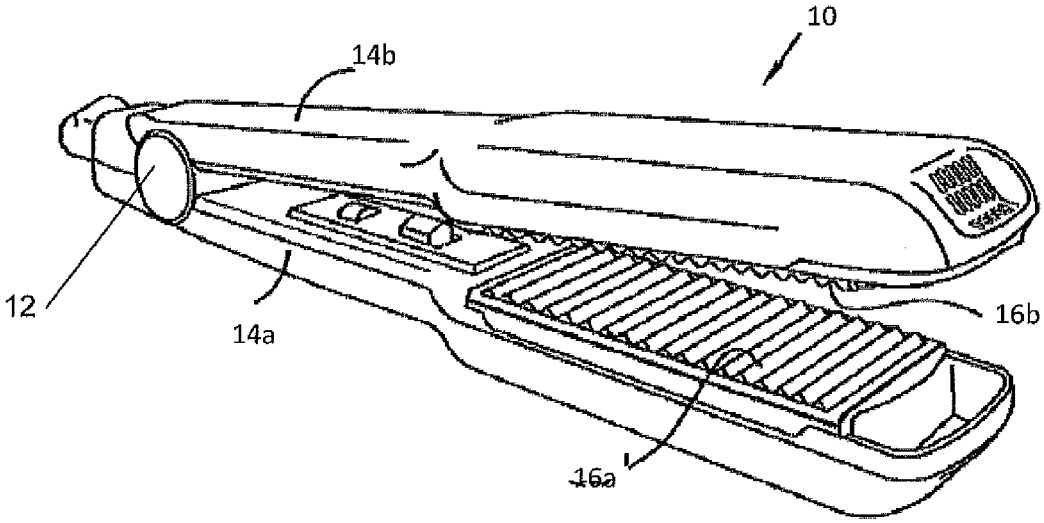
Figure 1b (prior art)
FIG. 1*b* shows an example of hair crimpers according to the prior art.

The fact that the rotating hinge component 2, 12 shown in FIGS. 1*b* and 1*b* has been removed brings the added advantage that more of the apparatus can be devoted to holding batteries allowing for increased charge storage. One or more of the shoulder variants shown in FIGS. 4*a* to 4*j* may also be used on the battery powered styling apparatus of FIG. 5.

In the embodiment shown in FIG. 5, the end point 49 forms a closeable opening through which batteries may be removable.

In other embodiments the batteries may by user non-removable and be fixed into the hair styling apparatus at manufacture. In such a variant it may then be necessary for a service engineer to dismantle and replace the batteries should this ever need to be done. In this embodiment end point 49 on the styling apparatus in FIG. 5 may then be used as a charging point or power point, providing a connection for an external power supply, preferably delivery a DC voltage (for example 24V) for charging the batteries.

In either of the embodiments in FIGS. 3*a*-3*c* and FIG. 5, the heatable plates may operate from AC or DC. In case of the battery powered apparatus of FIG. 5 it will be appreciated that DC powered heatable plates are preferred to avoid any power conversion from DC to AC. Furthermore, in either embodiment, operating from DC may also be generally safer for use.

Figure 8A:
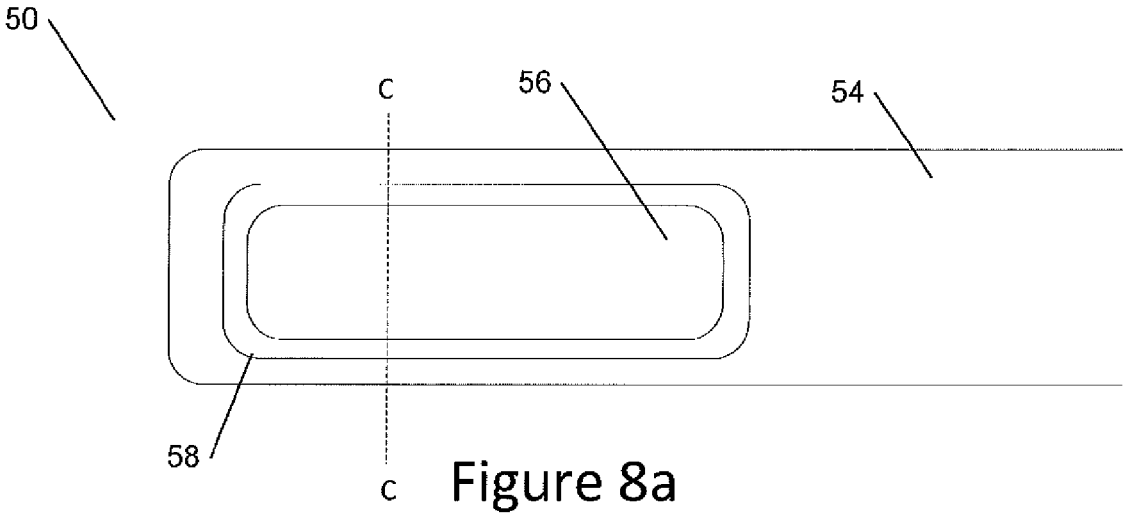
FIG. 8*a* shows a top down view of one of the arms of a hair styling apparatus showing details of the heatable plate and mounting.
Figure 8B:
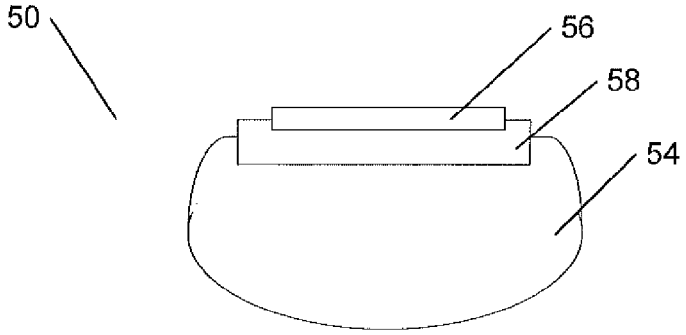
FIG. 8*b* further shows a cross-section through the arm of FIG. 8*a*

Turning now to FIGS. 8*a* and 8*b*, these show further details of the heatable plates and the means by which they are suspended on the arms of the hair styling apparatus.

FIG. 8*a* shows a top down view of one arm 54 of the hair styling apparatus 50. FIG. 8*b* shows a cross section through line 'C' in FIG. 8*a* of one arm, showing further details of the heatable plate and its mounting to the arm.

In FIG. 8*a*, a heatable plate assembly is formed from a heatable plate 56 supported on a resilient suspension. This resilient suspension comprises a flexible silicone rubber substrate 58 which is then attached to the surrounding arm 54. The silicone rubber substrate provides the heatable plate with a degree of movement relative to the arm 54 in which it is mounted. Allowing the heatable plate to move (pivot side to side, and/or pivot forward and backwards, and/or twist) may be useful, especially when a quantity of hair placed between the plates varies in thickness. The movement allows the heatable plates to retain an evening clamping across the quantity of hair between the plates during styling.

The flexible silicone rubber 58 also has a low thermal conductivity, meaning that is also acts as a thermal insulator, reducing or even eliminating the requirement for further thermal insulation below the heatable plate 56 shown in FIGS. 8*a* and 8*b*.

The heatable plate 56 may be supported on a silicone rubber substrate as depicted in FIG. 8*b* or in a variant, the heatable plate may be fitted into a rectangular silicone rubber O-ring to provide a resilient suspension. The O-ring is then attached to the arm or other section of the housing. It will be appreciated however that in this variant further insulation material may then be necessary to thermally isolate the heatable plate and any connected heater element to improve efficiency and prevent any heat up of other internal components or housing components.

The rubber mounted heatable plate assembly may be formed from a variety of methods, including forming the heatable plate and silicone rubber substrate separately, then bonding the two together. In this way, the silicone rubber substrate may be injection moulded separately.

In a variant of the manufacturing process a heatable plate assembly may be formed by injection moulding the silicone rubber substrate around the heatable plate itself. In this way, the heatable plate is retained by the silicon rubber substrate and further bounding may be avoided as the substrate sets to wrap around the heatable plate. To further improve the retention, the heatable plate may have one or more recesses or grooves into which the rubber substrate can flow as part of the injection moulding process.

The skilled person will appreciate that many other suitable alternatives to silicone rubber may be used, including other forms if synthetic rubber, especially those with favourable thermal insulation properties.

The heatable plate used may be any form of thermally conductive material, such as aluminium or copper, although it will be appreciated that aluminium may be preferable being lightweight and low cost. The heater element used may be one of those widely known to the skilled person or may be a form of low voltage DC heater element directly mounted onto an electrically insulating oxide layer formed on the underside (i.e. not visible to the user) of the heatable plate.

Figure 9A:
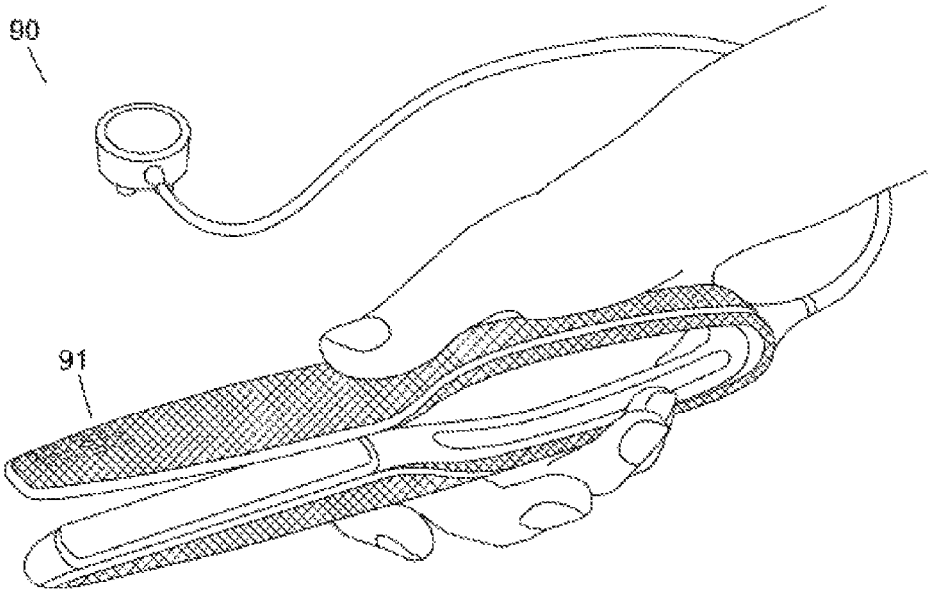
FIG. 9*a* shows a further arrangement of the hair styling apparatus held by a user and powered directly by AC mains electricity.
Figure 9B:
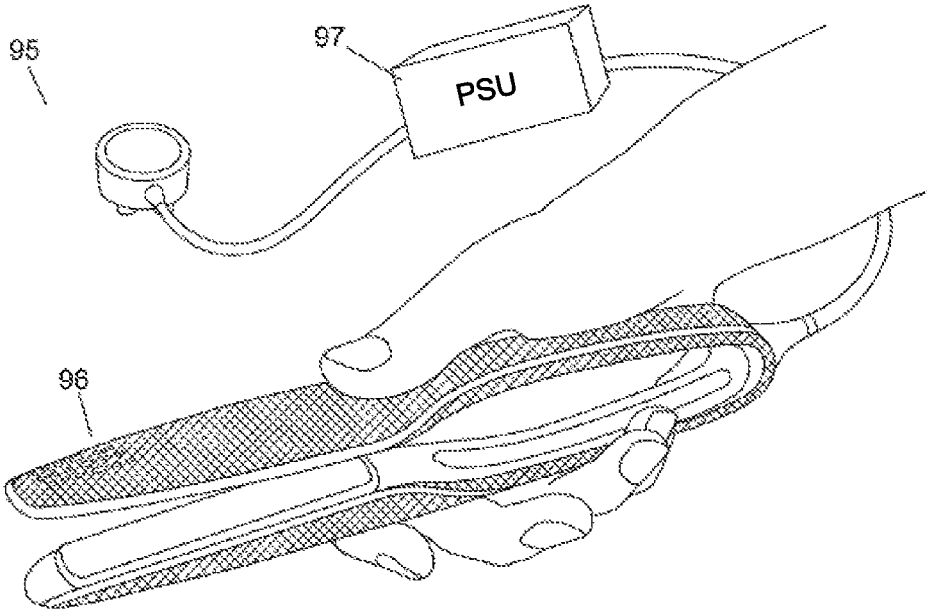
FIG. 9*b* shows a variant of the arrangement of FIG. 9*a* using an external power supply unit.

FIGS. 9*a* and 9*b* show examples of a corded styling apparatus in use. FIG. 9*a* shows a hair styling apparatus 91 powered directly by mains electricity, typically 110V or 230V. In such an embodiment the heatable plates may be mains powered. FIG. 9*b* shows a hair styling apparatus 96 including an external power supply unit 97. This external power supply may provide galvanic isolation of the mains electricity input and may also step down or step up the AC voltage. In variants, this external power supply 97 may also convert the AC mains electricity into a DC power source for driving DC powered components of the styling apparatus. In this way no AC to DC conversion is required for any DC components (such as control logic/microcontrollers and the like) in the arms of the styling apparatus reducing the weight. The heatable plates may be driven by AC or DC power depending on the particular construction of the heatable plate units.

To use the hair styling apparatus 91, 96, a user positions a section of hair to straighten between the heatable plates and then squeezes the arms together. To release the section of hair the squeezing force is removed, enabling the resiliently flexible arms and/or shoulder force the arms to move back to an open position.

Modular Shoulder Assembly

Figure 10A:
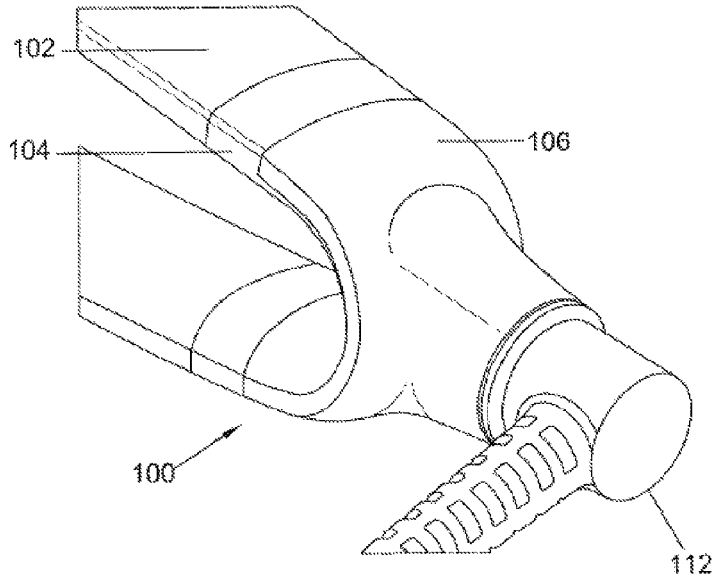
FIG. 10*a* is a perspective view of one embodiment of a shoulder assembly according to another aspect of the present invention.
Figure 10B:
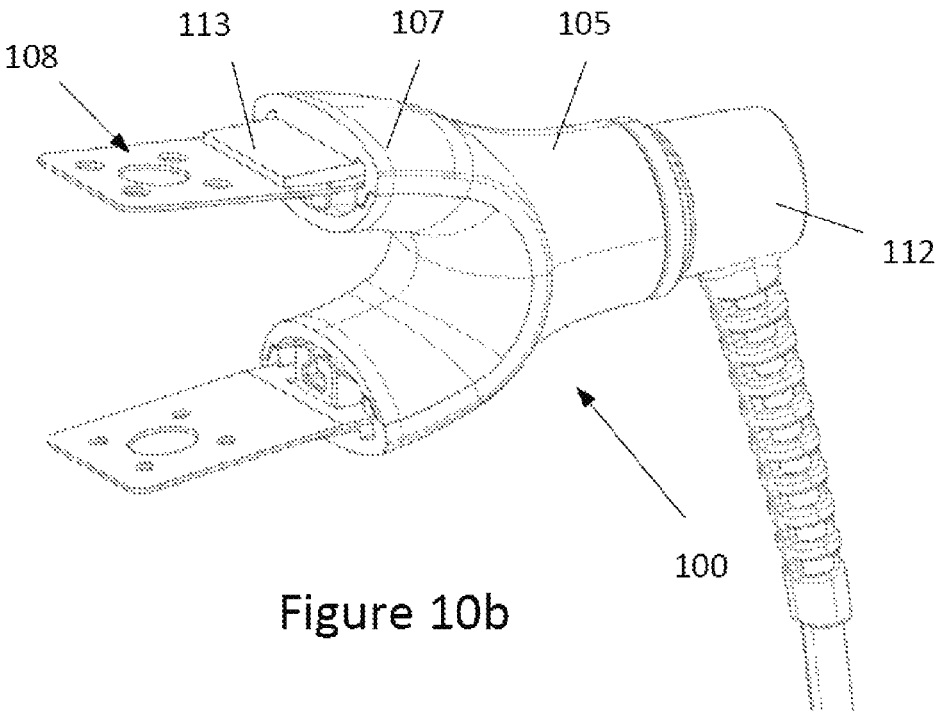
FIGS. 10*b* to 10*e* are internal views of the shoulder assembly of FIG. 10*a;*
Figure 15A:
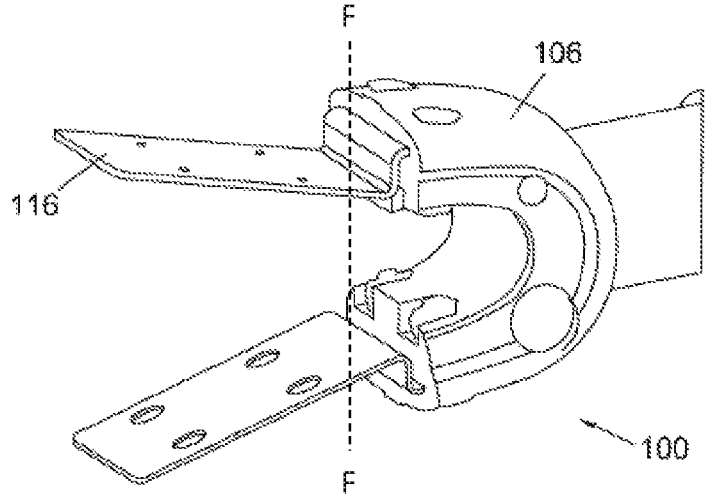
FIGS. 15*a* and 15*b* are perspective and cross-section views of an alternative shoulder assembly.
Figure 15B:
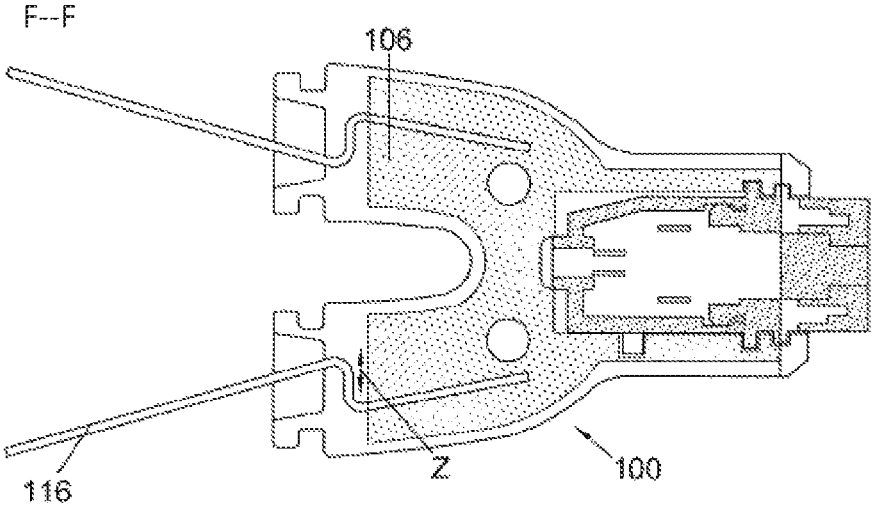

In the embodiments described above, the shoulder is typically integrally formed with the arms, e.g. as a continuous strip. As described in relation to FIGS. 6*a* to 6*c*, the continuous strip may be a chassis for supporting other components of the apparatus. FIG. 10*a* onwards show an extension of the chassis idea in the form of a shoulder assembly which is manufactured separately from and subsequently connected to the arms. The shoulder assembly is thus a modular component and as such may be incorporated in other appliances. The shoulder assembly may also be used to tune yaw stiffness, for example as described in relation to FIGS. 15*a* and 15*b*.

FIGS. 10*a* to 10*e* show an embodiment of the shoulder assembly 100 which connects to two arms 102 of a hair styling apparatus and thus connects the arms together. The shoulder assembly comprises a housing 106 comprising a central connector part 105 from which two projections 107 extend. The central connector 105 is adapted to receive an electrical connection to power the hair styling apparatus to which the shoulder assembly is connected. As shown, the central connector 105 is generally cylindrical but it will be appreciated that other shapes may be used depending on the nature of the electrical connection. Each of the two projections 107 connects to a corresponding arm of the hair styling apparatus. As shown, the two projections 107 form a continuous hollow curved generally U-shaped part with the central connector 105 centrally located relative to the two projections. In this embodiment, the central connector and two projections are integral with each other.

The housing 106 may be formed of a rigid metal such as cast aluminium, or from a rigid plastic or ceramic. The rigidity of the shoulder portion allows restriction of the yaw rotation of the arms of the hair styling apparatus, and also provides a strong, rigid housing for the electrical connections. For safety reasons, it is necessary for the electrical connections to be housed within a strong casing, to minimise the risk of the connections becoming loose over time or during use. The rigid material also eliminates the natural flexing point of the apparatus as the shoulder assembly resists lateral loads applied by the user to the arms of the hair styling apparatus. The arms 102 may themselves be rigid. Accordingly, the shoulder assembly also comprises a component to provide for movement between the two arms.

As shown in more detail in FIGS. 10*b* to 10*e*, the shoulder assembly is connected to each of the arms by a coupling member 108 which permits movement of the arms relative to each other and relative to the shoulder assembly. The coupling member may thus be considered to be flexible. In this embodiment, the coupling members 108 are in the form of flat springs which have a first portion 109 secured within the shoulder assembly 106 and a second portion 111 which extends beyond the shoulder assembly to be connected into the styler arms 102. The first and second portions 109, 111 are joined by a joint 210 which provides a hinge or pivot line about which the coupling member can flex. Furthermore, at least the second portion may be flexible. The coupling members 108 may be formed from, but not limited to, stainless spring steel or spring steel. Varying the thickness of the springs allows the force required to open/close the arms of the hair styling apparatus to be varied. Merely as an illustration, for a spring of thickness between 0.3 mm-1.5 mm, the closing force of the styler arms is between 0.48N-24.5N (assuming a constant geometry and constant spring material). The coupling members thus provide the hair styling apparatus with a hinge or pivot to allow the apparatus to be opened and closed (i.e. the arms to be brought into and out of contact with each other). The two springs of the shoulder assembly are disposed opposite each other in a similar manner to a pair of braised or welded tweezers.

Figure 10C:
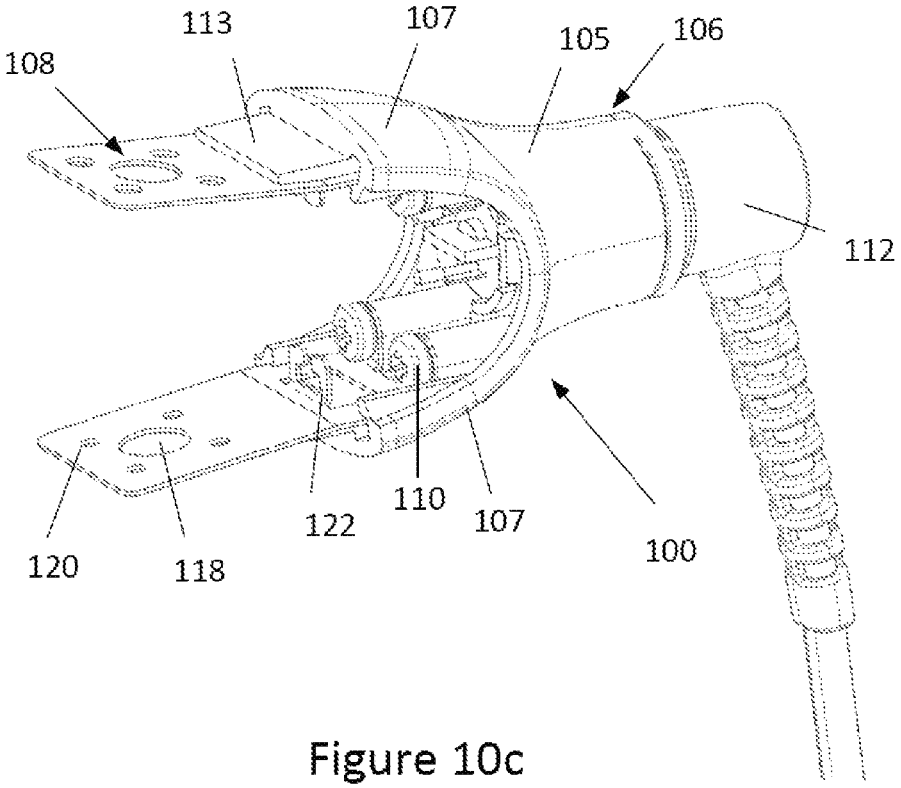
Figure 10D:
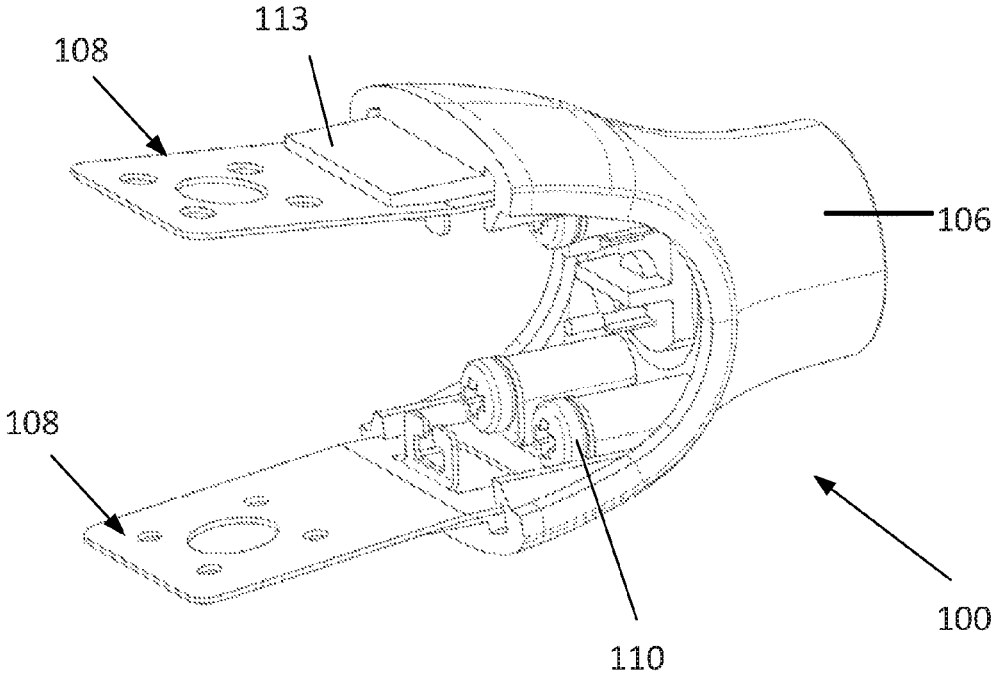
Figure 10E:
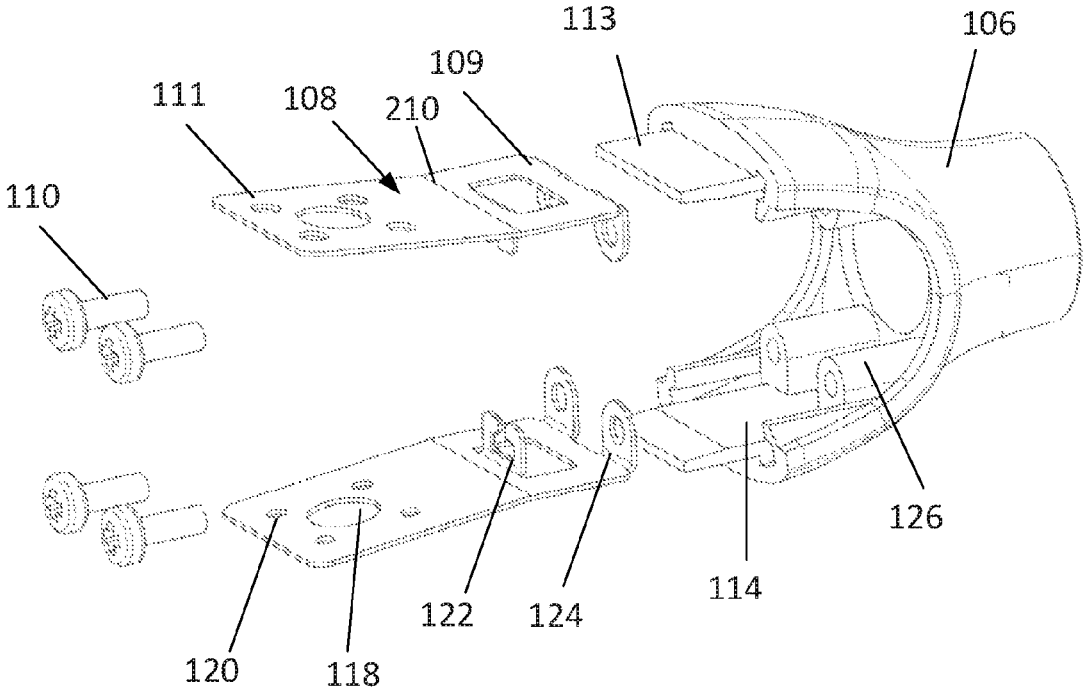

In the embodiment of the shoulder assembly shown in FIGS. 10*c* to 10*e*, each coupling member 108 is clamped within a projection 107 of the housing 106. The first portion 109 of each coupling member 108 comprises a pair of fixing plates 124 which extend generally perpendicular to the coupling member. Mechanical fixings such as screws 110 are inserted through screw holes in the fixing plates 124 into a fixing mounting 126 within the housing. It will be appreciated that other fixing mechanisms may be used.

In this embodiment, the housing also comprises a channel 114 within each projection. The channel 114 comprises slots for receiving each edge of the first portion. This channel may assist with restricting the yaw movement of the coupling members within the housing. The first portion of the coupling member is slotted into this channel before being mechanically fixed into place with the screws 110. The channel 114 and the fixings restrict side to side movement of the spring once the shoulder assembly has been assembled.

The first portion may also optionally comprise an arm travel stop 122, which is described in more detail below in relation to FIGS. 13*a* and 13*b*. A flange 113 projects from both projections on the housing, as shown for example in FIG. 10*b*. Each coupling member 108 is joined into the housing such that the spring is under tension. This is to ensure that the hair styler arms are open fully when the arms are in the open (rest) position, and so the arms do not collapse under their own weight when the arms are moved into the closed position (i.e. when a user applies force to bring the arms together). Consequently, when a user applies force to the arms, they experience a resistance. The flange 113 acts to maintain the opening angle of the styler arm. The coupling member 108 under tension pushes against the flange 113 which prevents the arms from opening beyond a particular desired angle. As described in more detail below, the open position of the arms of the hair styling apparatus is dictated by pre-loaded tension on the spring, which may be varied by changing the displacement angle X between the first and second portion.

In other embodiments of the shoulder assembly, the coupling members 108 may be joined into the housing by, but not limited to, one of the following processes:

- Inserting moulded or co-injected coupling members into a plastic or metal shoulder portion to chemically bond the coupling members to the shoulder
- Capturing coupling members between other components within the shoulder assembly during manufacture
- Press-fitting coupling members into a metal or plastic shoulder part
- Heat staking or welding of springs into a metal or plastic shoulder part The second portion comprises a plurality (e.g. four) of mounting screw holes 120 and a boss clearance hole 118. Screws are inserted through the screw holes 120 and into corresponding mountings (not shown) on the arm to secure the second portion to the arm. It will be appreciated that other fixing mechanisms may be used.

FIGS. 11*a* to 11*f* show the shoulder assembly coupled to a pair of arms. The shoulder assembly 100 is a modular component, which can be used to connect together the arms of any hair styling apparatus and to connect the arms to the power supply. Although FIGS. 11*a* to 11*f* depict the shoulder assembly connected to the arms of a hair straightener, the skilled person will understand that the arms could be replaced by those for curling tongs, combs or other hair styling apparatus. The shoulder assembly is Y-shaped or fork-shaped. The two 'prongs' or projections of the Y-shaped assembly couple to the arms of the hair styler and form the shoulder 106 of the hair styling apparatus, while the 'stem' of the Y-shaped assembly couples to the electrical connector 112. Thus, the assembly 100 may form the shoulder of any two-armed hair styling apparatus.

Figure 11A:
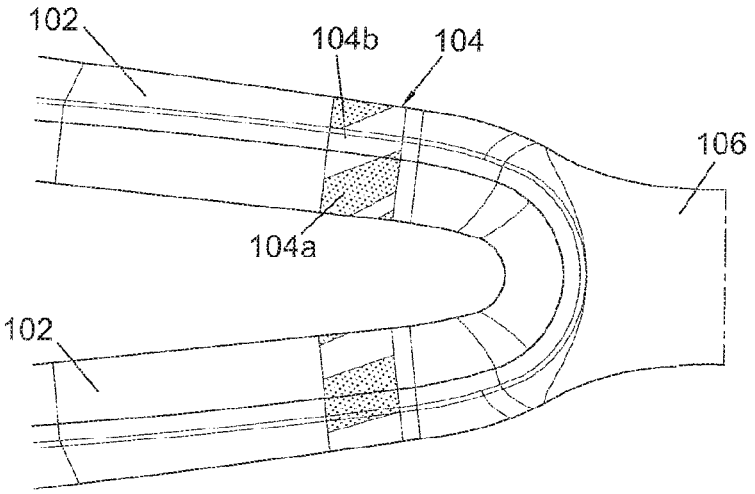
FIGS. 11*a* to 11*c* show partial, perspective and side views of a hair styling apparatus incorporating the shoulder assembly of FIG. 10*a* in an open position.
Figure 11B:
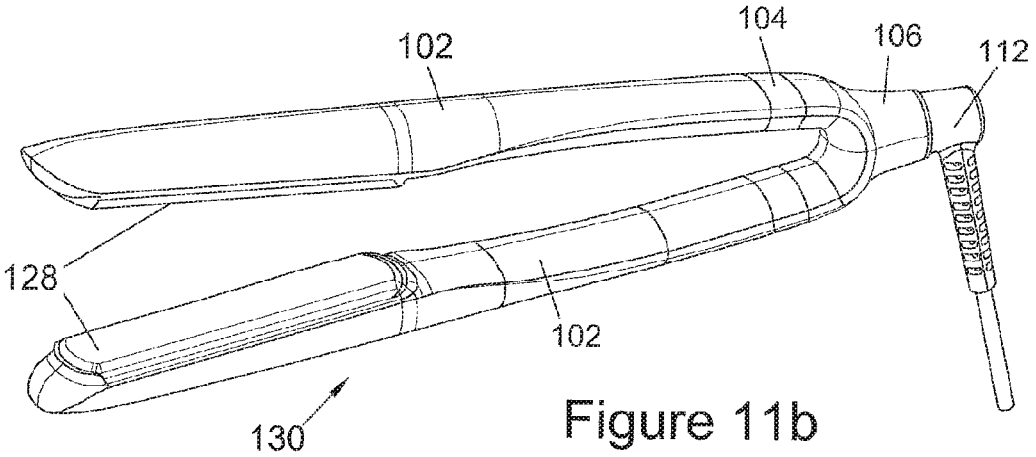
Figure 11C:
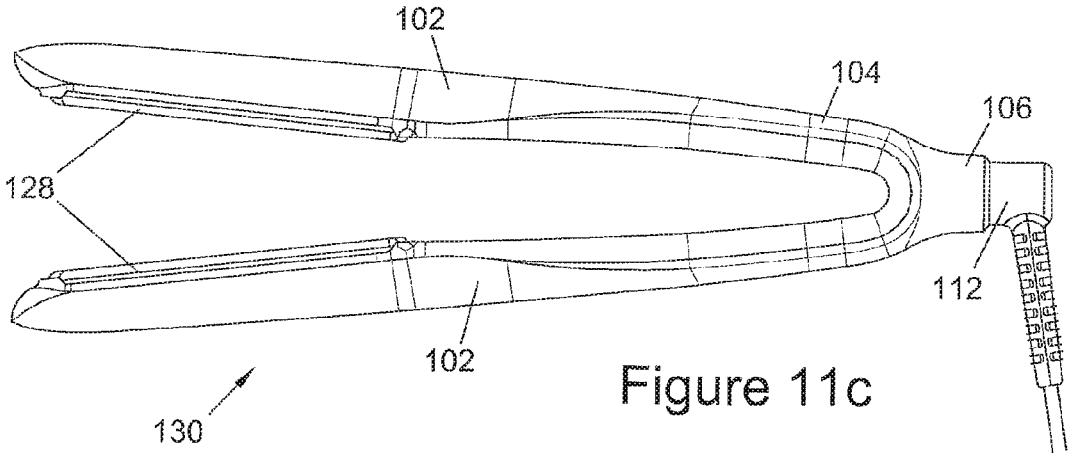

The hair styling apparatus shown in FIGS. 11*b* and 11*c* comprises a casing or chassis which may be formed from composite materials such as carbon fibre to provide a robust and lightweight styling apparatus. In other variants, component parts of the styling apparatus may be formed from carbon fibre, with other plastic and/or metal elements used to form the casing or chassis.

FIGS. 11*b* and 11*c* also show the electrical connector 112 which connects the heater plates 128 and circuitry of the hair styling apparatus to an external power supply. The connector 112 may be a swivel cable assembly, which provides greater rotational freedom of movement when the hair styling apparatus is in use. In this embodiment, the hair styling apparatus is powered directly by mains electricity, typically 110V or 230V. In such an embodiment the heatable plates may be mains powered. However, the hair styling apparatus may also include its own power supply unit which may be external or internal to the apparatus itself. This power supply may provide galvanic isolation of the mains electricity input and may also step down or step up the AC voltage. In variants, this power supply may also convert the AC mains electricity into a DC power source for driving DC powered components of the styling apparatus. In this way no AC to DC conversion is required for any DC components (such as control logic/microcontrollers and the like) in the arms of the styling apparatus reducing the weight. The heatable plates may be driven by AC or DC power depending on the particular construction of the heatable plate units.

When the user applies force to the arms to bring them closer together, a force is applied to each coupling member which causes each coupling member to flex inwards towards each other. The flexing may be about the hinge line and/or within the second portion itself (i.e. the material of the coupling member bends). In this way, each coupling member may be considered to be undergoing a similar motion to a diving board. The arms are then moved closer together. The housing of the shoulder assembly is rigid. Accordingly, no corresponding movement of the shoulder assembly occurs. It will thus be appreciated that if the arm and housing were in contact at the open (rest) position, moving the arms together would open up a gap at an upper surface. Moreover, the contact at the bottom surface may prevent or inhibit a user from closing the arms. Accordingly, it may be necessary to include a gap between the arm and the housing of the shoulder assembly at a lower surface. Such gaps would be unsightly and may also allow debris to enter the device which is not desirable.

The shoulder assembly 100 may thus comprise transition components 104 which are positioned between the projections (or prongs) of the housing and the arms and which compensate for movement in the hair styling apparatus arms relative to each other and relative to the shoulder assembly. The transition components 104 may be formed from, but not limited to, flexible plastic, rubber, silicon, liquid silicone rubber (LSR) or thermoplastic elastomers (TPE/TPU). The transition components may be integrally formed with the housing of the shoulder assembly or may be separate components (see FIGS. 12*a* to 12*e*). The transition components are flexible so that they expand/contract to provide a smooth or continuous surface with minimal gaps between the transition component and the shoulder component and the transition component and the arm respectively.

Figure 11D:
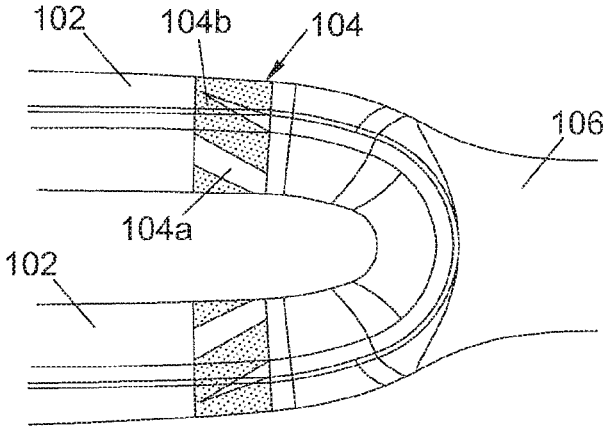
FIGS. 11*d* to 11*f* show partial, perspective and side views of a hair styling apparatus incorporating the shoulder assembly of FIG. 10*a* in a closed position.
Figure 11E:
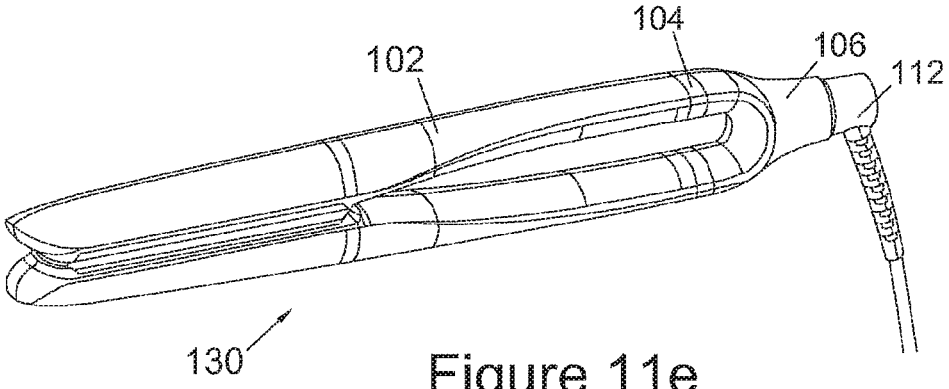
Figure 11F:
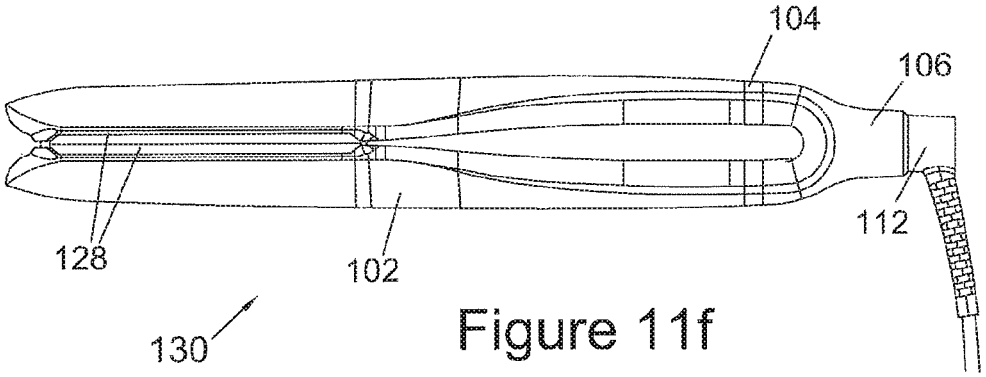

FIGS. 11*a* and 11*d* show the transition components 104 of the shoulder assembly 100 when the arms of the hair styling apparatus are in an open and a closed position, respectively. From FIG. 11*d* it can be seen that when the styling apparatus arms are forced together (as shown in FIGS. 11*e* and 11*f*), the inner portions of the transition components 104*a* are under compression/tension, while the outer transition portions 104*b* are expanded/stretched. When the arms are returned to the open (rest) position (as shown in FIGS. 11*b* and 11*c*), the inner and outer transition portions are in an equilibrium (or rest) position (i.e. they are not under tension). In the embodiment of the hair styling apparatus 130 shown in FIGS. 11*a* to 11*f*, the transition parts 104 are not under tension (i.e. at equilibrium) when the styler arms are open. However, the skilled person will understand that the apparatus 130 could also be reversed such that when the styler arms are closed the transition parts are in their equilibrium state.

Figure 12A:
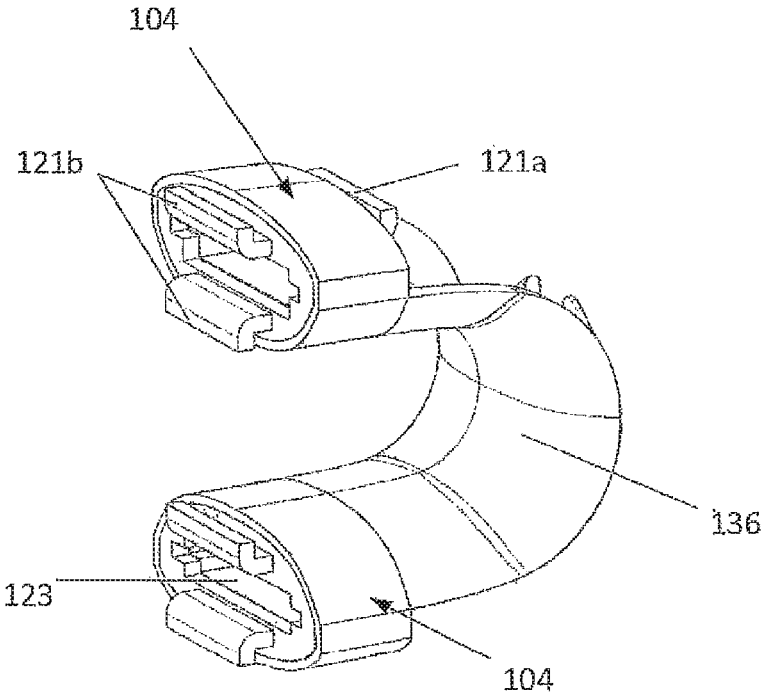
FIG. 12*a* shows a side view of a shoulder assembly incorporating a transition component.
Figure 12B:
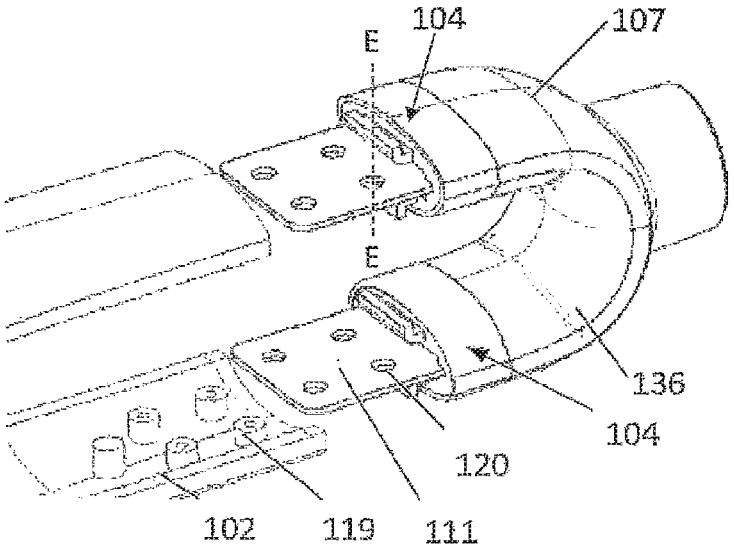
FIG. 12*b* shows an exploded side of the shoulder assembly of FIG. 12*a* coupling to a pair of arms.
Figure 12C:
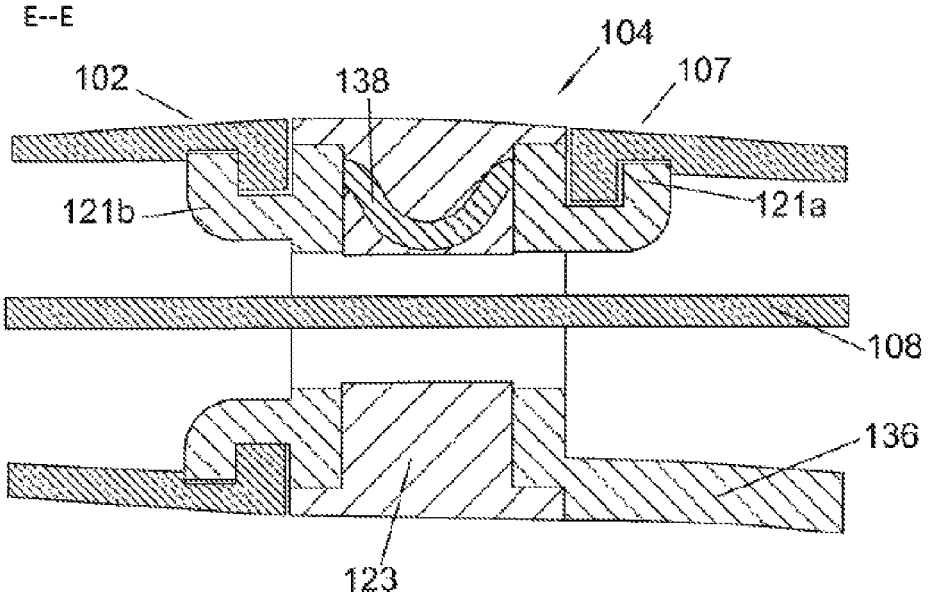
FIGS. 12*c* and 12*d* are cross-sectional view of two alternative transition components for use in FIG. 12*b;*
Figure 12D:
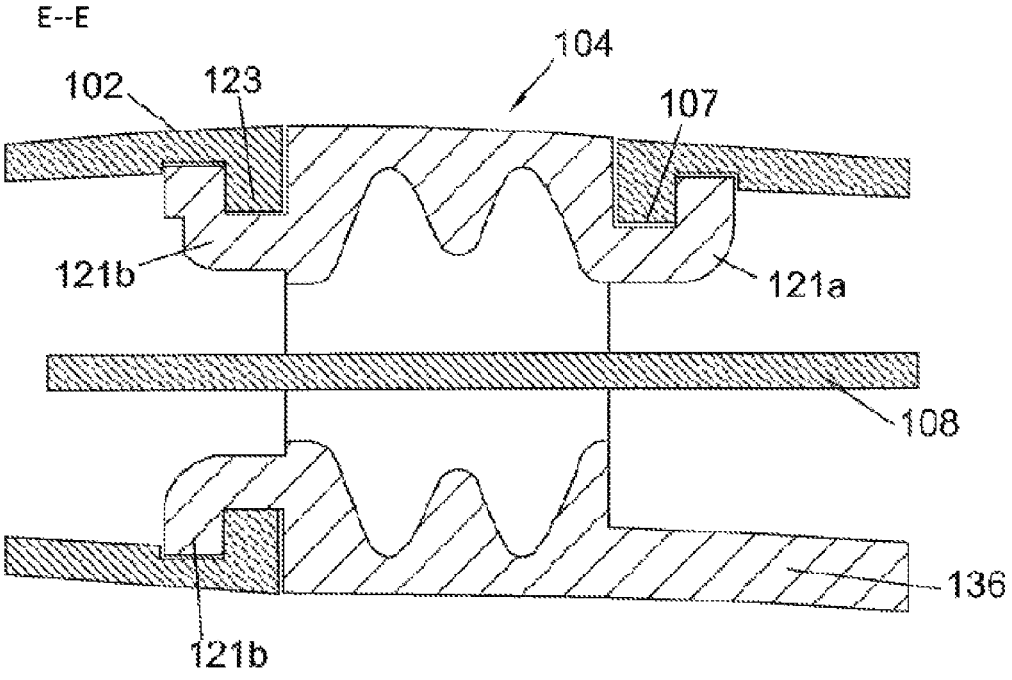
Figure 12E:
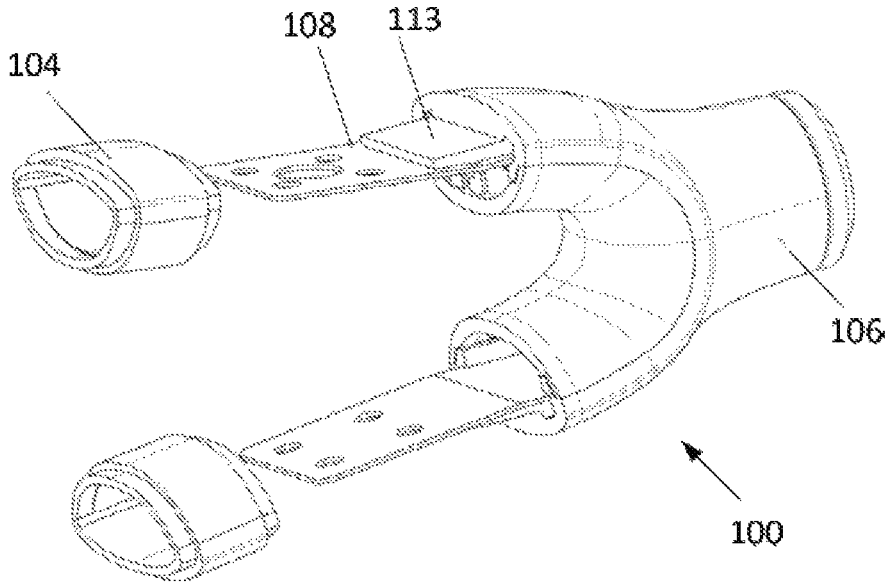
FIG. 12*e* shows a view of another embodiment of the transition component for coupling the shoulder assembly.

FIGS. 12*a* to 12*e* show various different transition components. FIGS. 12*a* and 12*b* show the external structure of the two variations of the transition component 104 with FIGS. 12*c* and 12*d* showing the internal structure of each transition component. FIG. 12*e* is an alternative embodiment.

FIG. 12*a* shows a pair of transition components 104 which are connected by a curved substrate 136. As shown in FIG. 12*b*, the curved substrate 136 forms an inner external surface of the shoulder assembly. It will be appreciated that the transition components do not need to be connected in this way. However, it may simplify manufacture by reducing the number of parts.

Each transition component 104 comprises hook-shaped portions 121*a* and 121*b*. The hook-shaped portions 121*a* interlock with corresponding projections of the housing 107 of the shoulder assembly and the hook-shaped portions 121*b* interlock with corresponding projections on the caseworks of the styler arm 102, thereby locking the transition portion 104 in place in the hair styling apparatus. As shown, there are two hook-shaped portions 121*b* to couple each styler arm to the transition component, and one hook-shaped portion 121*a* to couple the projection of the shoulder assembly to the transition component. It is feasible that the substrate 136 could be manufactured separately from each transition component 104 and in this case, an additional hook-shaped portion will be required to couple to an inner external surface of the shoulder assembly. The hook shaped portions also define a channel 123 for receiving each edge of the arm and/or shoulder assembly. This channel 123 may assist with restricting the yaw movement. It will be appreciated that the hook and channels are just one of many similar connection mechanisms which a skilled man may employ to connect the transition components to the arms and/or shoulder assembly. Once the transition component is attached to the shoulder assembly and/or arms, it is preferably not detachable.

FIG. 12*c* shows in cross section through the line E-E of FIG. 12*b*, one embodiment of a transition component for coupling the shoulder assembly housing 107 to the arm 102. Here, each transition part 104 is formed by a co-injection process that produces a rigid polymer substrate 136 and a flexible joint 138 which is preferably made of an elastomeric material. The flexible joint 138 is housed within the substrate 136 which effectively forms a sleeve for each transition components as well as the substrate connecting the two transition components. The flexible joint 138 connects the projections 121*a*, 121*b* for the arm and the shoulder assembly thus allowing the gap between the arm and shoulder assembly to be varied by varying the flex in the flexible joint.

FIG. 12*d* shows in cross section through the line E-E of FIG. 12*b*, another embodiment of a transition component. Here, the transition components 104 and connecting substrate 136 are constructed from one complete elastomeric material. The projections 121*a*, 121*b* for the arm and the shoulder assembly are connected by a flexible joint 138 as in the previous embodiment but the flexible joint 136 and substrate 136 are constructed from the same material as a continuous piece. The flexible joint 138 also thus forms the sleeve. This may simplify manufacture.

FIG. 12*e* shows another embodiment of the transition component in which each transition component 104 is an elastomeric grommet or sleeve-type component which slides over the spring 108 and locks into the housing of the shoulder assembly 100 and the styler arms (not shown). The two transition components 104 are not connected together.

FIGS. 12*a*, 12*b* and 12*e* also shows various components of the shoulder assembly itself. For example, FIG. 12*e* shows a flange 113 (or platform) which projects from the projections 107 of the housing. This may be used to ensure that the coupling member is biased at the correct angle as explained in more detail with reference to FIGS. 14*c* and 14*d*.

FIG. 12*b* also shows that the second portion 111 of the coupling member extends beyond the shoulder assembly to be connected into the styler arms 102. The second portion 111 comprises a plurality (e.g. four) of mounting screw holes 120, through which screws (not shown) are inserted into corresponding mountings 119 in the styler arm 102 to secure the second portion to the arm. Thus, once the first and second portions of the coupling member are coupled to the shoulder assembly and styler arm, the transition component is fixed in place.

Figure 13A:
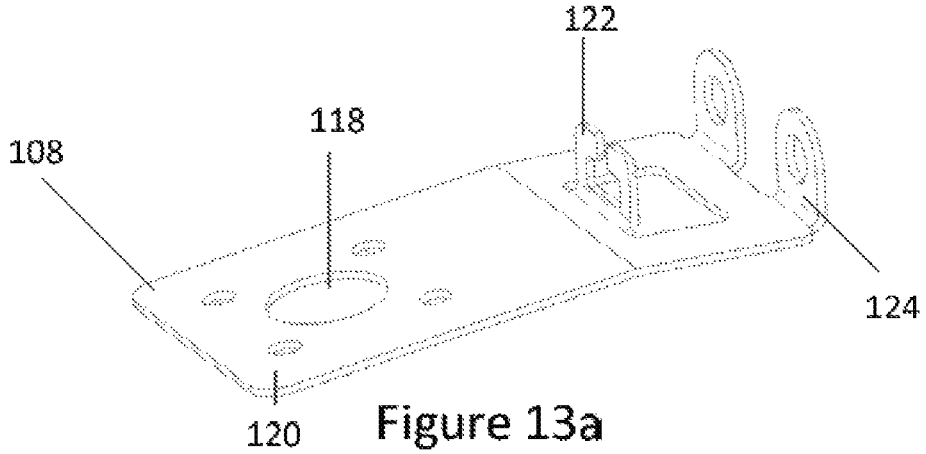
FIG. 13*a* is a perspective view of a component of the shoulder assembly.
Figure 13B:
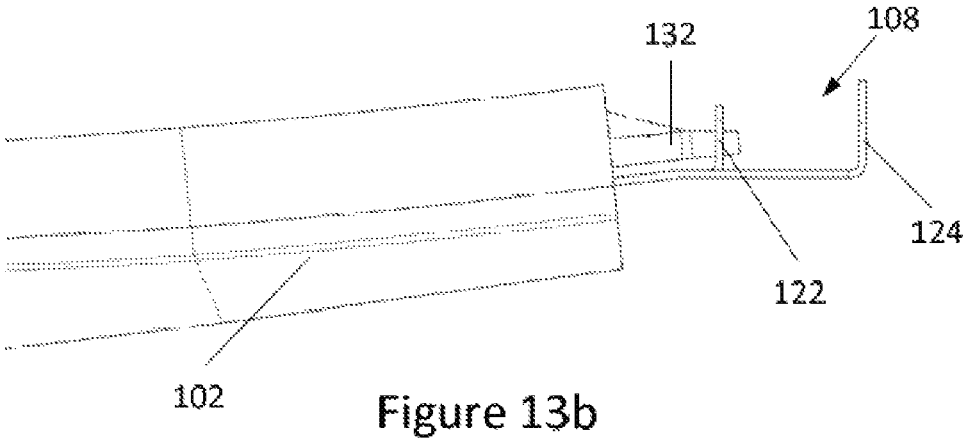
FIG. 13*b* is a partial side view showing the engagement of the component with the apparatus.
Figure 14A:
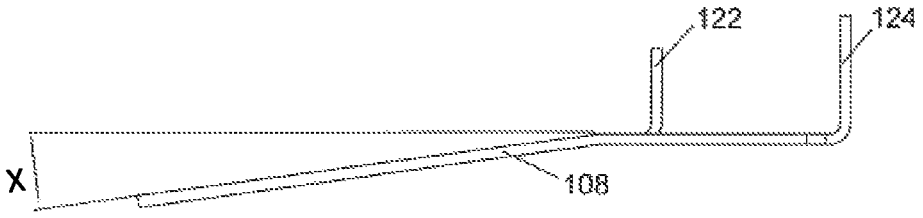
FIGS. 14*a* to 14*d* are side views of a component of the shoulder assembly illustrating optional improvements.

FIGS. 13*a* and 13*b* illustrate how the coupling members of the shoulder assembly co-operate with the arms of the hair styling apparatus. The hair styling apparatus may be in an open state when it is not in use. It is preferable to prevent the user from opening the arms further apart when using the apparatus (which increases the perception of quality and durability of the apparatus to the user). As mentioned earlier, each coupling member 108 comprise a styler arm travel stop 122 which extends generally perpendicularly to the coupling member. The styler arm travel stop 122 comprises an aperture. As shown in FIG. 13*b*, a wedge-shaped protrusion 132 from the casing of the styler arms 102 extends into the aperture of the upturned arm travel stop 122. If the user attempts to open the styler arms past their natural open state, the wedge-shaped protrusion 132 contacts the coupling member and restricts further movement of the styler arms 102. Referring now to FIG. 14*a*, the open position of the arms of the hair styling apparatus is dictated by pre-loaded tension on the spring, which may be varied by changing the displacement angle X between the first and second portion. For example, as shown in this embodiment, the angle may be approximately 20° or in the example shown in FIGS. 10*a* to 1*e*, the angle may be approximately 10°, i.e. the portions are generally in the same plane. The angle may be adjusted to suit different apparatuses. For example, in the present case, the angle is chosen to bias the arms in an open position.

As explained above, the styling apparatus 130 can move from the open to the closed position by a user indirectly applying force to the springs, that is, by directly applying force to the arms 102 of the styling apparatus 130. In FIG. 11*b*, the arms 102 are biased to the open position to enable a section of hair to be inserted between the heatable plates 128. To close the arms, a user squeezes the arms 102 together which causes one or both of the arms 102 to flex and move the heater plates 128 together (as shown in FIG. 11*e*). The shoulder 106 does not flex but remains rigid throughout. Relaxing a hold on the arms then allows the arms to flex or spring apart back to their resting position.

The spring closing force is directly related to spring material thickness, material and geometry. Assuming the material and geometry are constant, the thickness may be varied to vary the closing force. For example, the force may vary between 0.48N and 24.5N for a thickness varying between 0.3 mm and 1.5 mm.

| Spring thickness (mm) | Estimated force required (N) |
|---|---|
| 0.3 | 0.48 |
| 0.6 | 2.4 |
| 1.0 | 8.6 |
| 1.5 | 24.5 |

Figure 14B:
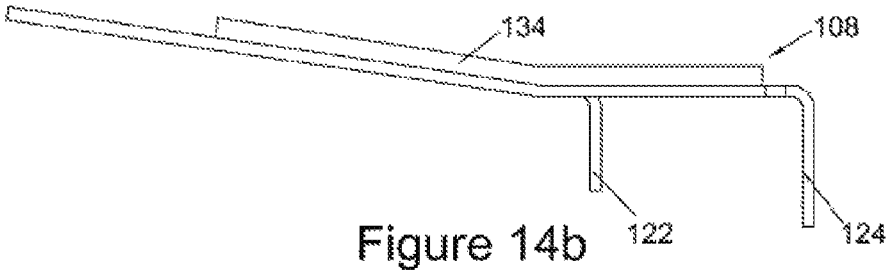

If a user releases the styler arms quickly from the closed position, the arms will experience simple harmonic motion. The oscillations do not affect the operation of the hair styling apparatus. However, the user's perception of the quality of the product may be compromised. As shown in FIG. 14*b*, the springs 108 may be coated with a layer of elastomeric material, such as silicon. The coating 134 is applied to the side of the spring 108 which is under tension when the styler arms are closed. The coating 134 acts to dampen any low frequency oscillations/vibrations. The skilled person will understand that the damping material may be applied to the spring by a variety of techniques, such as, but not limited to, a coating, spraying or dipping process. The skilled person will realise that other mechanisms to dampen the oscillations of the spring may be additionally or alternatively employed.

Figure 14C:
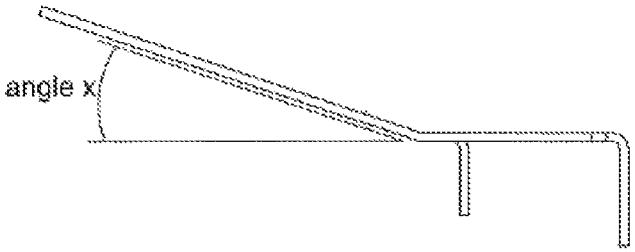
Figure 14D:
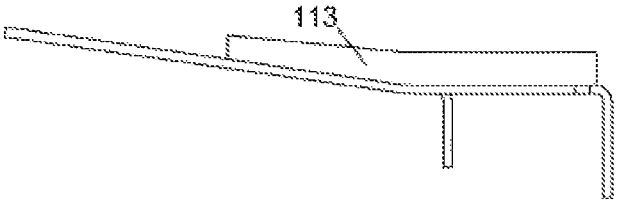

FIG. 14*c* shows that each spring is made with a certain amount of preloaded tension so that when it is installed into the shoulder assembly, it is under tension. This is to ensure that the styler arms are open fully and do not collapse/sag under their own weight. As soon as the user squeezes the styler arms they will experience a resistance. As shown in FIG. 14*d*, the spring pushes up against a flange 113 which adjusts the angle of the spring from the preloaded manufacture angle (of FIG. 14*c*) to the correct angle, i.e. the angle between the arms in a natural open state.

FIGS. 15*a* to 15*e* depict a second variant of the modular shoulder assembly 100 according to the present invention. As described earlier, the modular shoulder assembly may be used in a variety of hair styling apparatus. In the case of a hair straightener, it is generally necessary to minimise the yaw in the arms of the hair straightener. However, in other hair styling apparatus, a certain specified amount of yaw may be required to assist with the styling of hair or to make the apparatus easier to use. The shoulder assembly comprises a rigid housing 106 as with the previous embodiment and thus no yaw is permitted with such a housing. However, the coupling member is adapted to provide yaw.

Figure 15C:
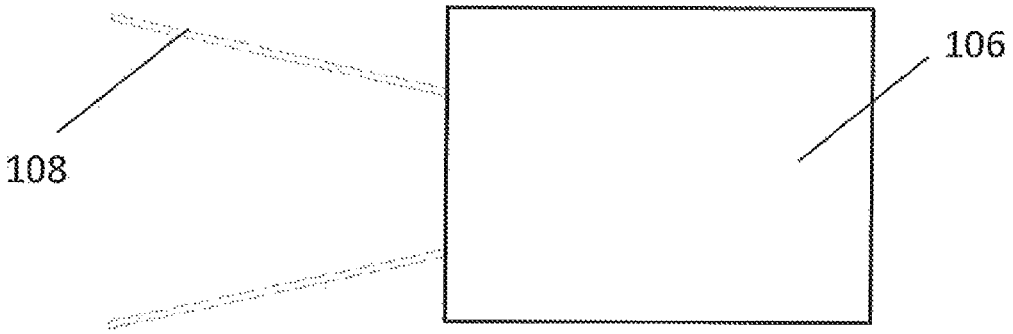
FIGS. 15*c* and 15*d* are schematic illustrations of two alternative shoulder assemblies.
Figure 15D:
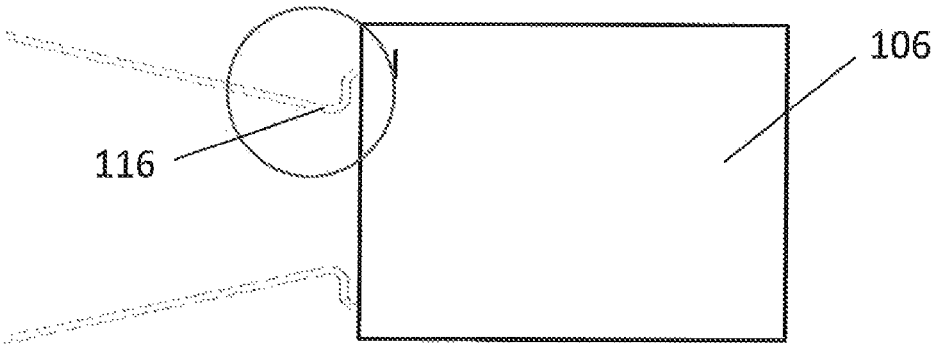

In this embodiment, the first portion of the coupling member which is mounted within the housing is connected to the second portion of the coupling member which couples to the arm (or other hair styling apparatus component) via a curved joint. Such a curved joint may be termed a "swan-neck". Accordingly, the coupling member may be termed a swan-necked spring 116 rather than a flat spring 108. FIGS. 15*c* and 15*d* illustrate the difference between a flat spring 108 and a swan necked spring.

Figure 15E:
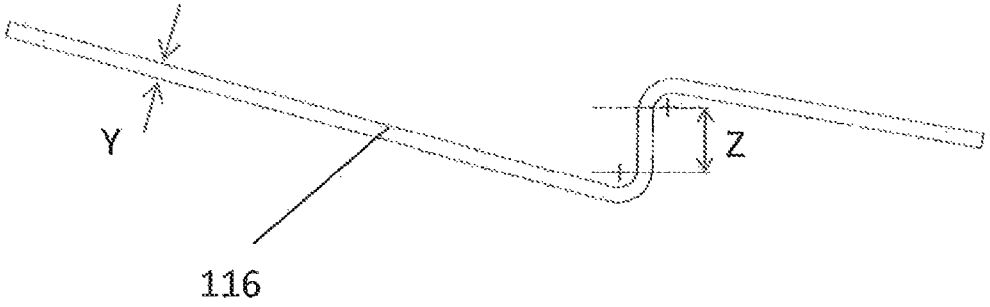
FIG. 15*e* is a schematic illustration of how the shoulder assembly of FIG. 15*a* may be adjusted.

As shown in FIG. 15*e*, the depth Z of the swan neck (curved joint) dictates the amount of yaw that can be created (based on a pre-determined constant thickness Y of the material used for the spring). The larger the depth Z, the less the lateral load required to create yaw. The styler yaw is defined as a distance travelled by the spring under a certain load. Merely as an illustration, for a spring of a particular thickness Y under a load of 1N may experience a yaw movement of 2.0 mm.

No doubt many other effective alternatives will occur to the skilled person. It will be understood that the invention is not limited to the described embodiments and encompasses modifications apparent to those skilled in the art lying within the spirit and scope of the claims appended hereto.

Through out the description and claims of this specification, the words "comprise" and "contain" and variations of the words, for example "comprising" and "comprise", means "including but not limited to, and is not intended to (and does not) exclude other moieties, additives, components, integers or steps.

Throughout the description and claims, the singular encompasses the plural unless the context otherwise requires. In particular, where the indefinite article is used, the specification is to be understood as contemplating plurality as well as singularity, unless the context requires otherwise.

Features, integers, characteristics or groups described in conjunction with a particular aspect, embodiment or example, of the invention are to be understood to be applicable to any other aspect, embodiment or example described herein unless incompatible therewith.

The invention claimed is:

1. A hair styling apparatus comprising a first arm carrying a first heated plate and a second arm carrying a second heated plate, a first end of the first arm and a first end of the second arm being joined by a shoulder assembly, wherein the first and second arms are moveable between an open position in which opposed ends of the arms to the shoulder assembly are spaced apart and a closed position in which the opposed ends of the arms carrying the heated plates are brought together and wherein the heated plates are configured for styling hair, wherein the shoulder assembly comprises:

a housing;

a first coupling member having a first end which is mounted within the housing and a second end which projects from the housing and attaches to the first end of the first arm in order to couple the housing to the first arm;

a second coupling member that is different from the first coupling member, the second coupling member having a first end which is mounted within the housing and a second end which projects from the housing and attaches to the first end of the second arm in order to couple the housing to the second arm;

wherein both the first and second coupling members are flexible so that the first arm is moveable relative to the second arm wherein the first and second coupling members are in the form of plate springs.

2. The hair styling apparatus of claim 1, wherein a thickness of the plate spring is between 0.3 mm and 1.5 mm.

3. The hair styling apparatus of claim 1, wherein each plate spring is in tension whereby the first and second arms are biased in a first position when the shoulder assembly is connected to the first and second arms.

4. The hair styling apparatus of claim 1 wherein each plate spring comprises a first and a second portion and the tension in each plate spring is adjusted by setting a displacement angle between the first portion and the second portion.

5. The hair styling apparatus of claim 4, wherein the displacement angle is between 10 to 20 degrees.

6. The hair styling apparatus of claim 1, wherein the housing of the shoulder assembly comprises a flange which projects from the housing adjacent at least one of the first and the second coupling members to maintain a constant angle between the housing and the at least one of the first and second coupling members.

7. The hair styling apparatus of claim 1, wherein at least one of the first and second coupling members comprises a damping component.

8. The hair styling apparatus of claim 1, wherein the shoulder assembly further comprises at least one arm travel stop which is configured to prevent a user from opening the first and second arms beyond the open position.

9. The hair styling apparatus of claim 8, wherein the at least one arm travel stop comprises an aperture which engages with a protrusion on the first or second arm.

10. The hair styling apparatus of claim 8, wherein the at least one arm travel stop is attached to the first or second coupling member.

11. The hair styling apparatus of claim 1, wherein the second end of each of the first and second coupling members is flexible.

12. The hair styling apparatus of claim 1, wherein the first and second ends of the first coupling member are joined by a joint and the first and second ends of the second coupling member are joined by a joint.

13. The hair styling apparatus of claim 1, wherein the housing of the shoulder assembly is rigid.

14. The hair styling apparatus of claim 1, wherein the shoulder assembly further comprises a first transition component which is connected to the housing in the shoulder assembly and which is connected to the first arm and a second transition component which is connected to said housing and which is connected to the second arm wherein the first and second transition components are configured to maintain a generally continuous surface between said housing and each arm when the first and second arms are moved relative to each other.

15. The hair styling apparatus of claim 14, wherein the first and second transition components are connected by a substrate; or wherein the first and second transition components comprise a rigid substrate and a flexible joint; or wherein the first and second transition components are formed from elastomeric material; or wherein the first and second transition components are in the form of sleeves.

16. The hair styling apparatus of claim 1, wherein the shoulder assembly further comprises an electrical connector which is connected to electrical components within the first and second arms.

17. The hair styling apparatus as claimed in claim 1, wherein the heating plates are adjacent each other when the arms are in the closed position.

* * * * *